US010717290B2

(12) United States Patent
Horade

(10) Patent No.: US 10,717,290 B2
(45) Date of Patent: Jul. 21, 2020

(54) LIQUID DISCHARGE DEVICE

(71) Applicant: BROTHER KOGYO KABUSHIKI KAISHA, Nagoya-shi, Aichi-ken (JP)

(72) Inventor: Kenta Horade, Toukai (JP)

(73) Assignee: BROTHER KOGYO KABUSHIKI KAISHA, Nagoya-Shi, Aishi-Ken (JP)

( * ) Notice: Subject to any disclaimer, the term of this patent is extended or adjusted under 35 U.S.C. 154(b) by 0 days.

(21) Appl. No.: 16/156,095

(22) Filed: Oct. 10, 2018

(65) Prior Publication Data

US 2019/0105914 A1 Apr. 11, 2019

(30) Foreign Application Priority Data

Oct. 10, 2017 (JP) ..... 2017-197173

(51) Int. Cl.
*B41J 2/175* (2006.01)
*B41J 29/38* (2006.01)
*B41J 29/13* (2006.01)

(52) U.S. Cl.
CPC ..... *B41J 2/17566* (2013.01); *B41J 2/1752* (2013.01); *B41J 2/17509* (2013.01); *B41J 2/17513* (2013.01); *B41J 2/17523* (2013.01); *B41J 2/17546* (2013.01); *B41J 2/17553* (2013.01); *B41J 29/13* (2013.01); *B41J 29/38* (2013.01); *B41J 2002/17573* (2013.01); *B41J 2002/17576* (2013.01)

(58) Field of Classification Search
CPC .. B41J 2/17566; B41J 2/17513; B41J 2/1752; B41J 2/17523; B41J 2/17509; B41J 2/175; B41J 29/38; B41J 2/17546; B41J 2/17503; B41J 2/17543; B41J 2/17506; B41J 29/393
See application file for complete search history.

(56) References Cited

U.S. PATENT DOCUMENTS 6,866,355 B2 * 3/2005 Aruga ..... B41J 2/17509 347/7
2008/0204488 A1 8/2008 Usui

FOREIGN PATENT DOCUMENTS

JP 2008-213162 A 9/2008

* cited by examiner

*Primary Examiner* — Jannelle M Lebron
(74) *Attorney, Agent, or Firm* — Merchant & Gould P.C.

(57) ABSTRACT

A liquid discharge device includes a case receiving a cartridge having a first liquid chamber, a tank having a second liquid chamber, a head, a liquid level sensor, an interface, an alarm and a controller configured to: when the cartridge is installed in the case, read a liquid amount Vc stored in the first liquid chamber from a cartridge memory through the interface; read a liquid amount Vs stored in the second liquid chamber from a memory; calculate a threshold based on the liquid amount Vc read from the cartridge memory and the liquid amount Vs read from the memory; update a count value with a value equivalent to an amount of liquid instructed to be discharged by a discharge instruction; and operate the alarm when the updated count value reaches the threshold.

9 Claims, 10 Drawing Sheets

LIQUID DISCHARGE DEVICE

CROSS-REFERENCE TO RELATED APPLICATION

This application claims priority from Japanese Patent Application No. 2017-197173 filed on Oct. 10, 2017, the entire subject-matter of which is incorporated herein by reference.

TECHNICAL FIELD

The disclosure relates to a liquid discharge device for discharging a liquid.

BACKGROUND

There has been known an inkjet printer including a detachable main tank, a sub tank that stores ink supplied from the mounted main tank, and an image recording unit that discharges the ink stored in the sub tank and records an image. In the inkjet printer having the above configuration, internal spaces of the main tank and the sub tank are opened to the air. For this reason, when the main tank is installed in the inkjet printer, the ink moves due to a water head pressure so that the liquid level of the main tank and the liquid level of the sub tank are aligned with the same height by the difference between a water head in the internal space of the main tank and a water head in the internal space of the sub tank (hereinafter, referred to as "water head difference"). Then, the inkjet printer displays exchange of the main tank on a display when the residual amount of the ink detected by a residual amount detection sensor is less than a threshold, or displays the fact that the ink is empty.

SUMMARY

A liquid discharge device includes a case receiving a cartridge having a first liquid chamber, a tank having a second liquid chamber, a head, a liquid level sensor, an interface, an alarm and a controller configured to: when the cartridge is installed in the case, read a liquid amount Vc stored in the first liquid chamber from a cartridge memory through the interface; read a liquid amount Vs stored in the second liquid chamber from a memory; calculate a threshold based on the liquid amount Vc read from the cartridge memory and the liquid amount Vs read from the memory; update a count value with a value equivalent to an amount of liquid instructed to be discharged by a discharge instruction; and operate the alarm when the updated count value reaches the threshold.

DETAILED DESCRIPTION

Figure 1A:
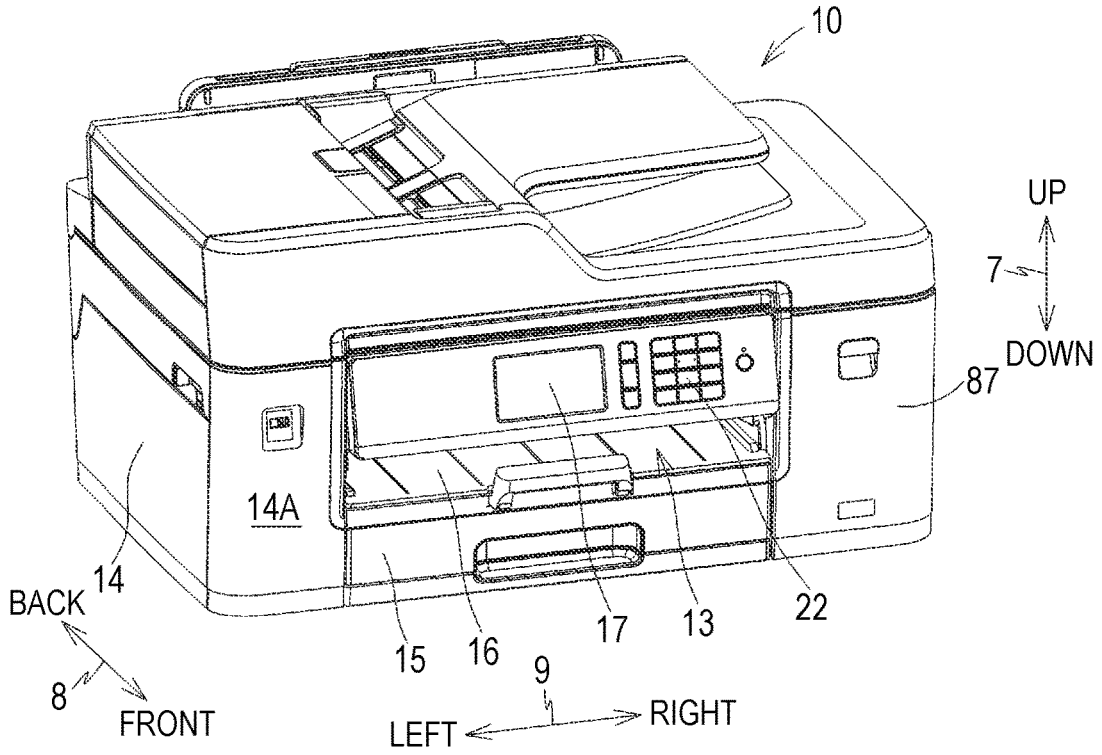
FIG. 1A is an external perspective view of a printer and illustrates a state where a cover is in a covering position.

When the residual amount detection sensor breaks down, the inkjet printer can hardly detect the residual amount of consumable ink. As a result, the inkjet printer can hardly notify the user of exchange of the cartridge or ink empty.

In addition, when the residual amount detection sensor breaks down, the inkjet printer may continue the operation of consuming ink through the image recording unit despite the fact that there is no residual amount of ink that can actually be consumed. As a result, the ink in the sub tank disappears, and air may enter the image recording unit from the sub tank.

The disclosure has been made in view of the above circumstances, and one object thereof is to provide a unit capable of notifying the user of exchange of the cartridge or ink empty even when the liquid level sensor breaks down. Further, another object of the disclosure is to provide a unit capable of preventing air from entering the head from the tank even when the liquid level sensor breaks down.

An exemplary embodiment of the disclosure will be described below. It is noted that the exemplary embodiment described below is merely an example of the disclosure and can be appropriately modified without departing from the spirit of the disclosure. In addition, an up and down direction 7 is defined with reference to a posture of a printer 10 installed in a horizontal plane in a usable manner, a front and back direction 8 is defined with a surface on which an opening 13 of the printer 10 is formed as a front surface, and a left and right direction 9 is defined when viewing the printer 10 from the front surface. In the exemplary embodiment, the up and down direction 7 in the use posture corresponds to a vertical direction, and the front and back direction 8 and the left and right direction 9 correspond to a horizontal direction. The front and back direction 8 and the left and right direction 9 are orthogonal to each other.

(Outline of Printer)

The printer 10 according to the exemplary embodiment is an example of a liquid discharge device that records an image on a sheet using an inkjet recording method. The printer 10 has a housing 14 having substantially rectangular parallelepiped shape. Further, the printer 10 may be a so-called "multifunction peripheral" having a facsimile function, a scan function, and a copy function.

Figure 1B:
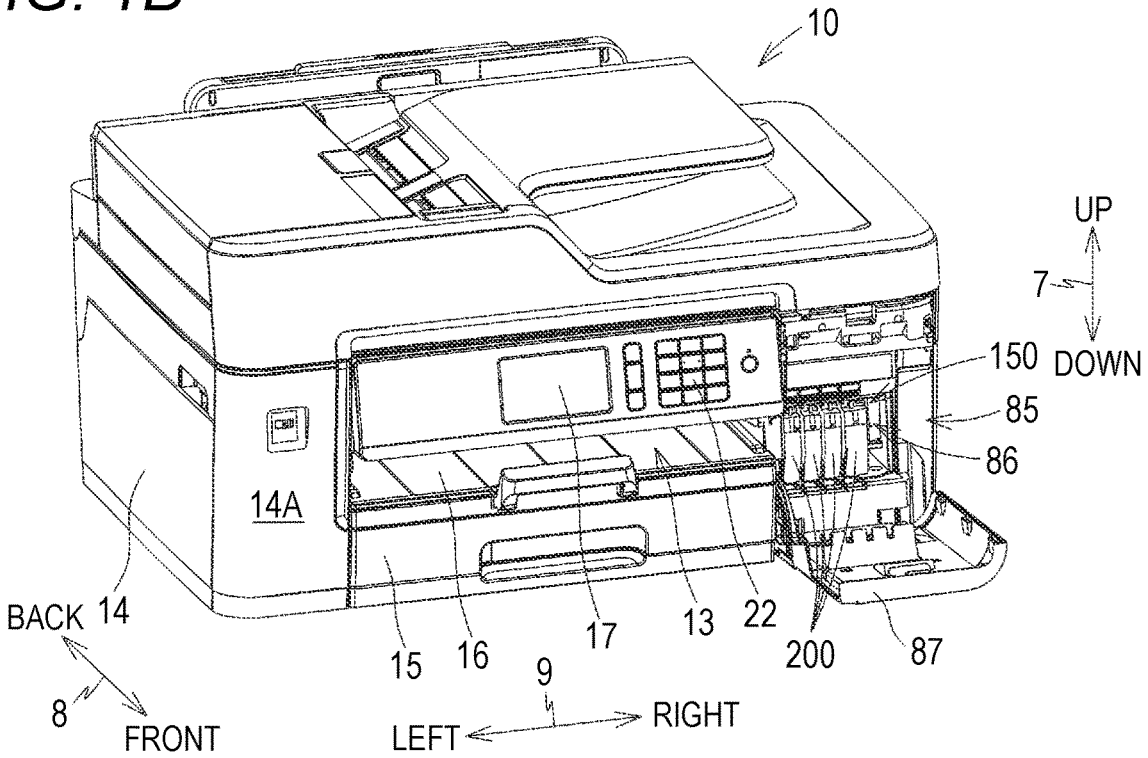
FIG. 1B is an external perspective view of the printer and illustrates a state where the cover is in an exposing position.
Figure 2:
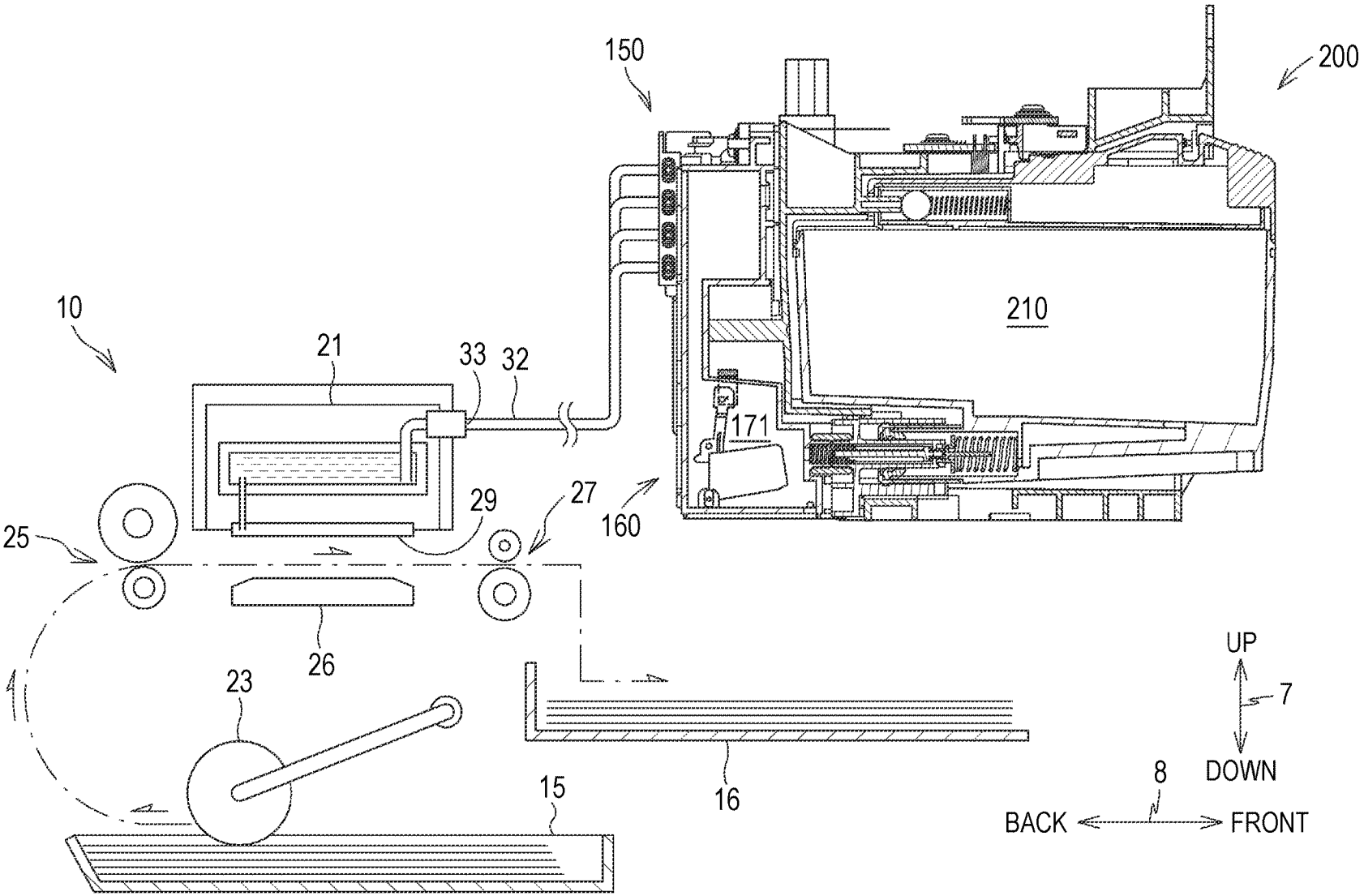
FIG. 2 is a schematic sectional view schematically illustrating an internal structure of the printer.

As illustrated in FIGS. 1A, 1B, and 2, the housing 14 includes therein a feed tray 15, a feed roller 23, a conveyance roller 25, a head 21 including a plurality of nozzles 29, a platen 26 facing the head 21, a discharge roller 27, a discharge tray 16, an installation case 150 to which a cartridge 200 is detachably attached, and a tube 32 for communicating the head 21 with the cartridge 200 installed in the installation case 150.

The printer 10 drives the feed roller 23 and the conveyance roller 25 to convey a sheet supported by the feed tray 15 to the position of the platen 26. Next, the printer 10 discharges an ink, which is supplied from the cartridge 200 installed in the installation case 150 through the tube 32, to the head 21 through the nozzle 29. Thus, the ink is landed on the sheet supported by the platen 26, and an image is recorded on the sheet. Then, the printer 10 drives the discharge roller 27 to discharge the sheet, on which the image is recorded, to the discharge tray 16.

More specifically, the head 21 may be mounted on a carriage that reciprocates in a main scanning direction intersecting with the sheet conveyance direction of the sheet by the conveyance roller 25. Then, the printer 10 may cause the head 21 to discharge ink through the nozzle 29 in the course of moving the carriage from one side to the other side in the main scanning direction. Thus, an image is recorded on a partial area of the sheet (hereinafter, referred to as "one pass") facing the head 21. Next, the printer 10 may cause the conveyance roller 25 to convey the sheet so that a next image recording area of the sheet faces the head 21. Then, these processes are alternately and repeatedly executed, and thus an image is recorded on one sheet.

In the exemplary embodiment, the discharge of ink from the nozzle 29 of the head 21 in the image recording is referred to as "jetting", while the discharge of ink from the nozzle 29 of the head 21 in the purging is referred to as "jetting", but the "jetting" is conceptually included in the "discharge".

(Cover)

As illustrated in FIGS. 1A and 1B, an opening 85 is formed at a right end in the left and right direction 9 on a front surface 14A of the housing 14. The housing 14 further includes a cover 87. The cover 87 is rotatable between a covering position (a position illustrated in FIG. 1A) at which the opening 85 is covered and an exposing position (a position illustrated in FIG. 1B) at which the opening 85 is exposed. The cover 87 is supported by the housing 14 so as to be rotatable around a rotation axis along the left and right direction 9 in the vicinity of a lower end of the housing in the up and down direction 7, for example. Then, the installation case 150 is located in an accommodating space 86 which is provided inside the housing 14 and spreads backwards from the opening 85.

(Cover Sensor)

Figure 6:
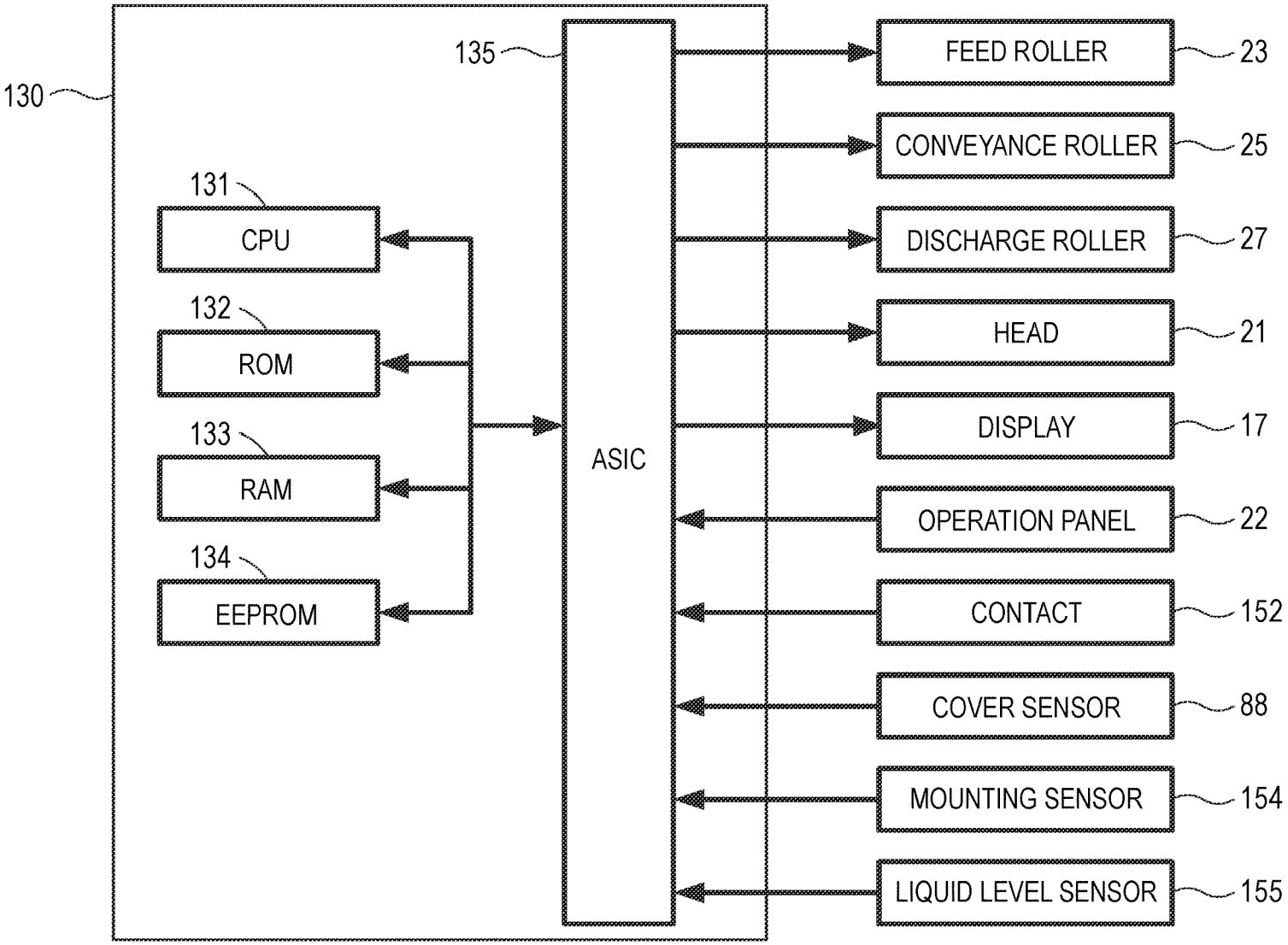
FIG. 6 is a block diagram of the printer.

The printer 10 includes a cover sensor 88 (see FIG. 6). The cover sensor 88 may be, for example, a mechanical sensor such as a switch with and from which the cover 87 contacts and separates, or an optical sensor in which light is blocked or transmitted depending on the position of the cover 87. The cover sensor 88 outputs a signal corresponding to the position of the cover 87 to a controller 130. More specifically, the cover sensor 88 output a low-level signal to the controller 130 when the cover 87 is located at the covering position. On the other hand, the cover sensor 88 outputs a high-level signal having higher signal intensity than the low-level signal to the controller 130 when the cover 87 is located at a position different from the covering position. In other words, the cover sensor 88 outputs the high-level signal to the controller 130 when the cover 87 is located at the exposing position.

(Installation Case)

Figure 3:
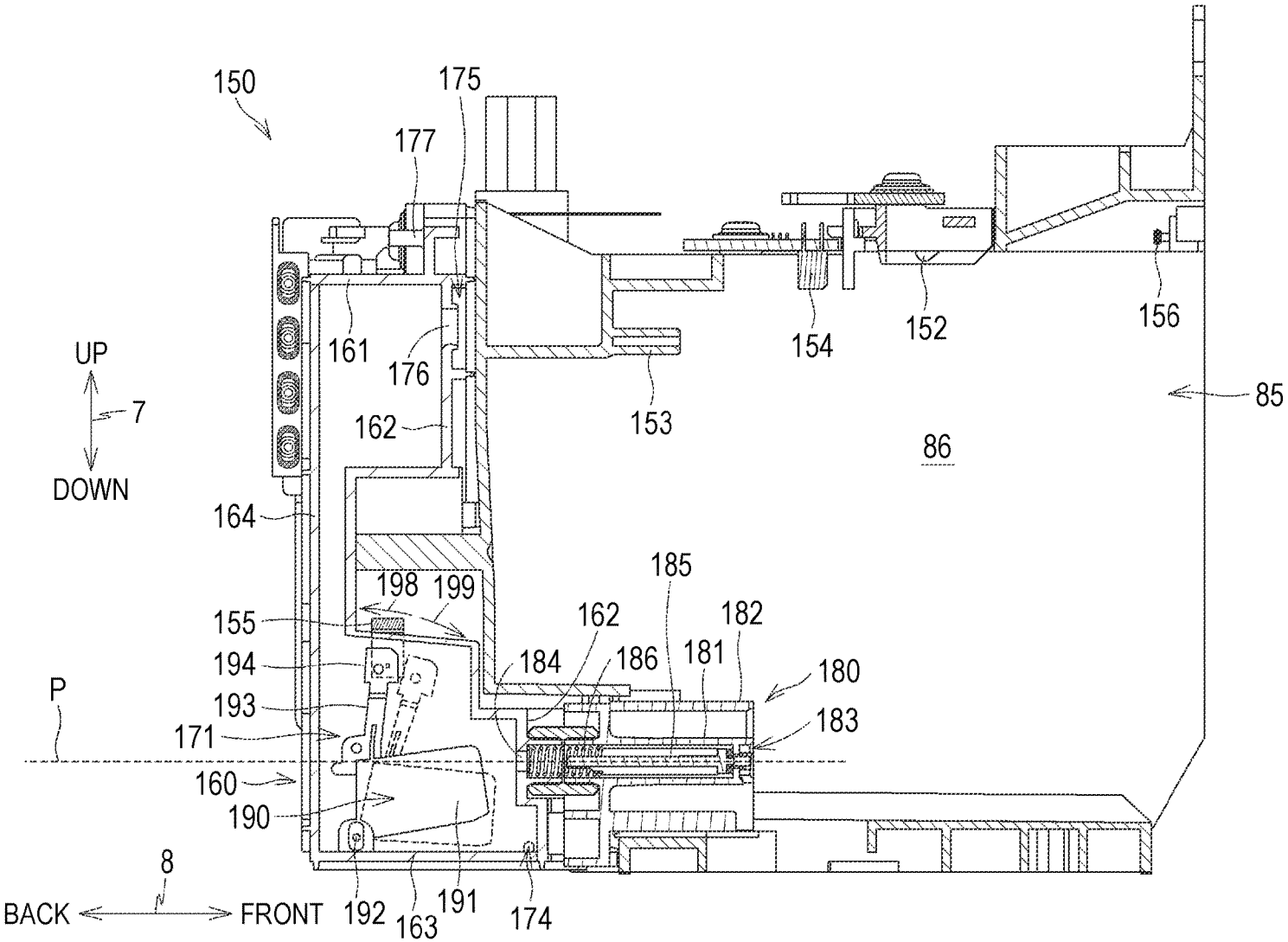
FIG. 3 is a longitudinal sectional view of an installation case.

As illustrated in FIG. 3, the installation case 150 includes a contact 152, a rod 153, an installation sensor 154, a liquid level sensor 155, and a lock pin 156. The installation case 150 can accommodate four cartridges 200 corresponding to respective colors of black, cyan, magenta, and yellow. That is, the installation case 150 includes four contacts 152, four rods 153, four installation sensors 154, and four liquid level sensors 155 corresponding to four cartridges 200. Four cartridges 200 are installed in the installation case 150, but one cartridge or five or more cartridges may be installed. The contact 152 is an example of an interface.

The installation case 150 has a box shape having an internal space in which the cartridge 200 is accommodated. The internal space of the installation case 150 is defined by a top wall defining an upper end top wall, a bottom wall defining a lower end, an inner wall defining a rear end in the front and back direction 8, and a pair of sidewalls defining both ends in the left and right direction 9. On the other hand, the opening 85 is located to face the inner wall of the installation case 150. That is, the opening 85 exposes the inner space of the installation case 150 to the outside of the printer 10 when the cover 87 is disposed at the exposing position.

Then, the cartridge 200 is inserted into the installation case 150 through the opening 85 of the housing 14, and is pulled out of the installation case 150. More specifically, the cartridge 200 passes backwards through the opening 85 in the front and back direction 8, and is installed in the installation case 150. The cartridge 200 pulled out of the installation case 150 passes forward through the opening 85 in the front and back direction 8.

(Contact)

The contact 152 is located on the top wall of the installation case 150. The contact 152 protrudes downwardly toward the internal space of the installation case 150 from the top wall. The contact 152 is located so as to be in contact with an electrode 248 (to be described below) of the cartridge 200 in a state where the cartridge 200 is installed in the installation case 150. The contact 152 has conductivity and is elastically deformable along the up and down direction 7. The contact 152 is electrically connected to the controller 130.

(Rod)

The rod 153 protrudes forward from the inner wall of the installation case 150. The rod 153 is located above a joint 180 (to be described below) on the inner wall of the installation case 150. The rod 153 enters an air valve chamber 214 through an air communication port 221 (to be described below) of the cartridge 200 in the course of installing the cartridge 200 on the installation case 150. When the rod 153 enters the air valve chamber 214, the air valve chamber 214 to be described below communicates with the air.

(Installation Sensor)

The installation sensor 154 is located on the top wall of the installation case 150. The installation sensor 154 is a sensor for detecting whether the cartridge 200 is installed in the installation case 150. The installation sensor 154 includes a light emitting portion and a light receiving portion which are separated from each other in the left and right direction 9. In the state where the cartridge 200 is installed in the installation case 150, a light shielding rib 245 (to be described below) of the cartridge 200 is located between the light emitting portion and the light receiving portion of the installation sensor 154. In other words, the light emitting portion and the light receiving portion of the installation sensor 154 are located opposite to each other across the light shielding rib 245 of the cartridge 200 installed in the installation case 150.

The mounting sensor 154 outputs a different signal (denoted as "mounting signal" in the drawings) depending on whether the light irradiated along the left and right direction 9 from the light emitting portion is received by the light receiving portion. The mounting sensor 154 outputs a low-level signal to the controller when an intensity of the light received by the light receiving portion is lower than threshold intensity, for example. Meanwhile, the mounting sensor 154 outputs a high-level signal having higher signal intensity than the low-level signal to the controller 130 when the intensity of the light received by the light receiving portion is equal to or higher than the threshold intensity.

(Liquid Level Sensor)

The liquid level sensor 155 is a sensor for detecting whether a detection target portion 194 of an actuator 190 (to be described below) is located at a detection position. The liquid level sensor 155 includes a light emitting portion and a light receiving portion which are separated from each other in the left and right direction 9. In other words, the light emitting portion and the light receiving portion of the liquid level sensor 155 are located opposite to each other across the detection target portion 194 located at the detection position. The liquid level sensor 155 outputs a different signal (denoted as "liquid level signal" in the drawings) depending on whether the light output from the light emitting portion is received by the light receiving portion. The mounting sensor 155 outputs a low-level signal to the controller when an intensity of the light received by the light receiving portion is lower than threshold intensity, for example. Meanwhile, the mounting sensor 155 outputs a high-level signal having higher signal intensity than the low-level signal to the controller 130 when the intensity of the light received by the light receiving portion is equal to or higher than the threshold intensity. The high-level signal is an example of a second signal, and the low-level signal is an example of a first signal.

(Lock Pin)

The lock pin 156 is a rod-like member extending along the left and right direction 9 at the upper end of the internal space of the installation case 150 and in the vicinity of the opening 85. Both ends of the lock pin 156 in the left and right direction 9 are fixed to the pair of sidewalls of the installation case 150. The lock pin 156 extends in the left and right direction 9 across four spaces in which four cartridges 200 can be accommodated. The lock pin 156 is used to hold the cartridge 200 installed in the installation case 150 at a mounting position illustrated in FIG. 5. The cartridge 200 is engaged with the lock pin 156 in a state of being installed in the installation case 150.

(Tank)

The printer 10 includes four tanks 160 corresponding to four cartridges 200. The tank 160 is located backwards from the inner wall of the installation case 150. As illustrated in FIG. 3, the tank 160 includes an upper wall 161, a front wall 162, a lower wall 163, a rear wall 164, and a pair of sidewalls (not illustrated). The front wall 162 includes a plurality of walls which deviate from each other in the front and back direction 8. A liquid chamber 171 is formed inside the tank 160. The liquid chamber 171 is an example of a second liquid chamber.

Among the walls forming the tank 160, at least the wall facing the liquid level sensor 155 has translucency. Thus, the light output from the liquid level sensor 155 can penetrate through the wall facing the liquid level sensor 155. At least a part of the rear wall 164 may be formed of a film welded to the upper wall 161, the lower wall 163, and an end face of the sidewall. In addition, the sidewall of the tank 160 may be common to the installation case 150, or may be independent of the installation case 150. Moreover, the tanks 160 adjacent to each other in the left and right direction 9 are partitioned by a partition wall (not illustrated). Four tanks 160 have substantially the common configuration.

The liquid chamber 171 communicates with an ink flow path (not illustrated) through an outflow port 174. A lower end of the outflow port 174 is defined by the lower wall 163 defining the lower end of the liquid chamber 171. The outflow port 174 is located below the joint 180 (more specifically, a lower end of a through hole 184) in the up and down direction 7. The ink flow path (not illustrated) communicating with the outflow port 174 communicates with the tube 32 (see FIG. 2). Thus, the liquid chamber 171 communicates with the head 21 from the outflow port 174 through the ink flow path and the tube 32. That is, the ink stored in the liquid chamber 171 is supplied from the outflow port 174 to the head 21 through the ink flow path and the tube 32. The ink flow path and the tube 32 communicating with the outflow port 174 is which one end (outflow port 174) communicates with the liquid chamber 171 and the other end 33 (see FIG. 2) communicates with the head 21.

The liquid chamber 171 communicates with the air through an air communication chamber 175. More specifically, the air communication chamber 175 communicates with the liquid chamber 171 through the through hole 176 penetrating the front wall 162. In addition, the air communication chamber 175 communicates with the outside of the printer 10 through an air communication port 177 and a tube (not illustrated) connected to the air communication port 177. That is, the air communication chamber 175 is which one end (through hole 176) communicates with the liquid chamber 171 and the other end (air communication port 177) communicates with the outside of the printer 10. The air communication chamber 175 communicates with the air through the air communication port 177 and the tube (not illustrated).

(Joint)

As illustrated in FIG. 3, the joint 180 includes a needle 181 and a guide 182. The needle 181 is a tube in which a flow path is formed. The needle 181 protrudes forward from the front wall 162 defining the liquid chamber 171. An opening 183 is formed at a protruding tip of the needle 181. In addition, the internal space of the needle 181 communicates with the liquid chamber 171 through a through hole 184 penetrating the front wall 162. The needle 181 is an example of a flow path in which one end (opening 183) communicates with the outside of the tank 160 and the other end (through hole 184) communicates with the liquid chamber 171. The guide 182 is a cylindrical member disposed around the needle 181. The guide 182 protrudes forward from the front wall 162 and has a protruding end which is opened.

In the internal space of the needle 181, a valve 185 and a coil spring 186 are located. In the internal space of the needle 181, the valve 185 is movable between a closed position and an open position in the front and back direction 8. The valve 185 closes the opening 183 when being positioned at the closed position. Further, the valve 185 opens the opening 183 when being located at the open position. The coil spring 186 urges forward the valve 185 in a moving direction from the open position to the closed position, that is, the front and back direction 8.

(Actuator)

The actuator 190 is located in the liquid chamber 171. The actuator 190 is supported by a support member (not illustrated) disposed in the liquid chamber 171 so as to be rotatable in directions of arrows 198 and 199. The actuator 190 is rotatable between a position indicated by a solid line in FIG. 3 and a position indicated by a broken line. Further, the actuator 190 is prevented from rotating in the direction of the arrow 198 from the position of the solid line by a stopper (not illustrated; for example, an inner wall of the liquid chamber 171). The actuator 190 includes a float 191, a shaft 192, an arm 193, and a detection target portion 194.

The float 191 is formed of a material having a smaller specific gravity than the ink stored in the liquid chamber 171. The shaft 192 protrudes in the left and right direction 9 from right and left sides of the float 191. The shaft 192 is inserted into a hole (not illustrated) formed in the support member. Thus, the actuator 190 is supported by the support member so as to be rotatable around the shaft 192. The arm 193 extends substantially upwardly from the float 191. The detection target portion 194 is located at a protruding tip of the arm 193. The detection target portion 194 is a plate-like member extending in the up and down direction 7 and the front and back direction 8. The detection target portion 194 is formed of a material or color that shields the light output from the light emitting portion of the liquid level sensor 155.

When a liquid level of the ink stored in the liquid chamber 171 is equal to or higher than a predetermined position P, the actuator 190 rotated in the direction of the arrow 198 by buoyancy is held at the detection position indicated by the solid line in FIG. 3, by the stopper. On the other hand, when the liquid level of the ink is lower than the predetermined position P, the actuator 190 rotates in the direction of the arrow 199 as the liquid level lowers. Thus, the detection target portion 194 moves to a position out of the detection position. That is, the detection target portion 194 moves to a position corresponding to the amount of ink stored in the liquid chamber 171.

The predetermined position P has the same height as an axial center of the needle 181 in the up and down direction 7, and has the same height as a center of an ink supply port 234 (to be described below). However, the predetermined position P is not limited to the position as long as it is located above the outflow port 174 in the up and down direction 7. As another example, the predetermined position P may be a height of the upper end or the lower end of the internal space of the needle 181, or may be a height of an upper end or a lower end of the ink supply port 234.

When the liquid level of the ink stored in the liquid chamber 171 is equal to or higher than the predetermined position P, the light output from the light emitting portion of the liquid level sensor 155 is blocked by the detection target portion 194. Thus, since the light output from the light emitting portion does not reach the light receiving portion, the liquid level sensor 155 outputs a low-level signal to the controller 130. On the other hand, when the liquid level of the ink stored in the liquid chamber 171 is lower than the predetermined position P, since the light output from the light emitting portion reaches the light receiving portion, the liquid level sensor 155 outputs a high-level signal to the controller 130. That is, the controller 130 can detect from the signal output from the liquid level sensor 155 whether the liquid level of the ink stored in the liquid chamber 171 is equal to or higher than the predetermined position P.

(Cartridge)

Figure 4A:
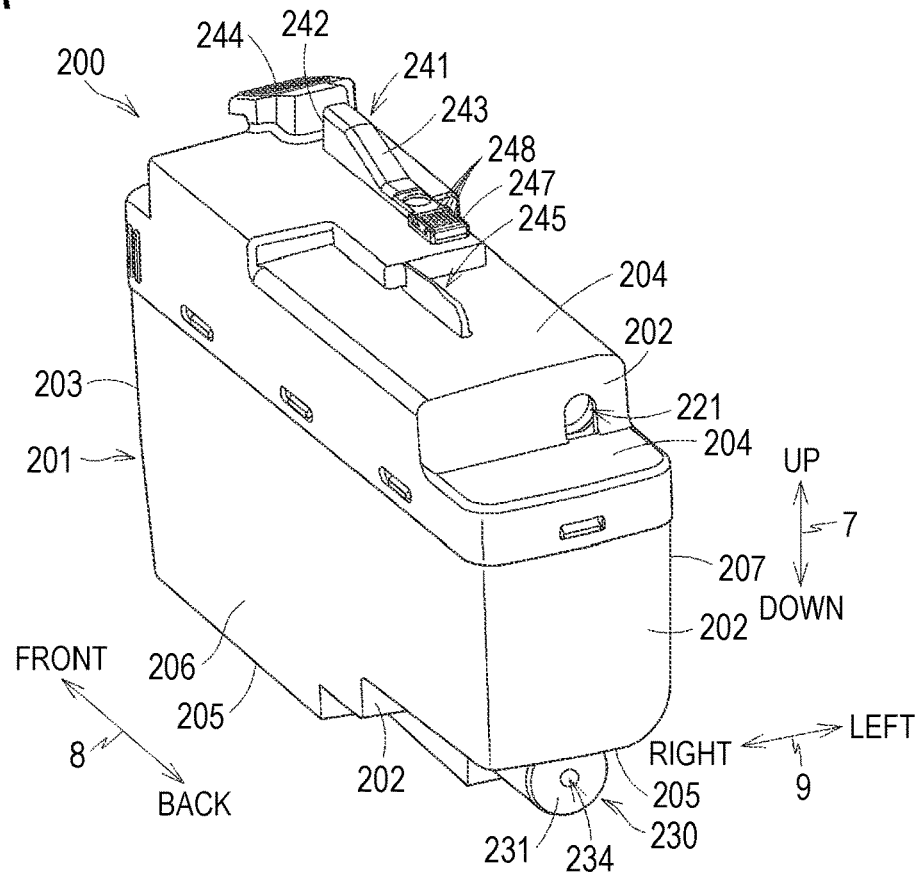
FIG. 4A is a front perspective view illustrating a structure of a cartridge.

The cartridge 200 is a container including a liquid chamber 210 (see FIG. 2) capable of storing ink, which is an example of a liquid, therein. The liquid chamber 210 is defined by a resin wall, for example. As illustrated in FIG. 4A, the cartridge 200 has a flat shape in which dimensions in the up and down direction 7 and the front and back direction 8 are larger than a dimension in the left and right direction 9. The cartridges 200 capable of storing inks of other colors may have the same outer shape or different outer shapes. At least a part of the walls forming the cartridge 200 has translucency. Thus, a user can visually recognize the liquid level of the ink, which is stored in the liquid chamber 210 of the cartridge 200, from the outside of the cartridge 200.

The cartridge 200 includes a housing 201 and a supply tube 230. The housing 201 is formed with a rear wall 202, a front wall 203, an upper wall 204, a lower wall 205, and a pair of sidewalls 206 and 207. The rear wall 202 includes a plurality of walls that deviate from each other in the front and back direction 8. In addition, the upper wall 204 includes a plurality of walls that deviate from each other in the up and down direction 7. Further, the lower wall 205 includes a plurality of walls that deviate from each other in the up and down direction 7.

Figure 4B:
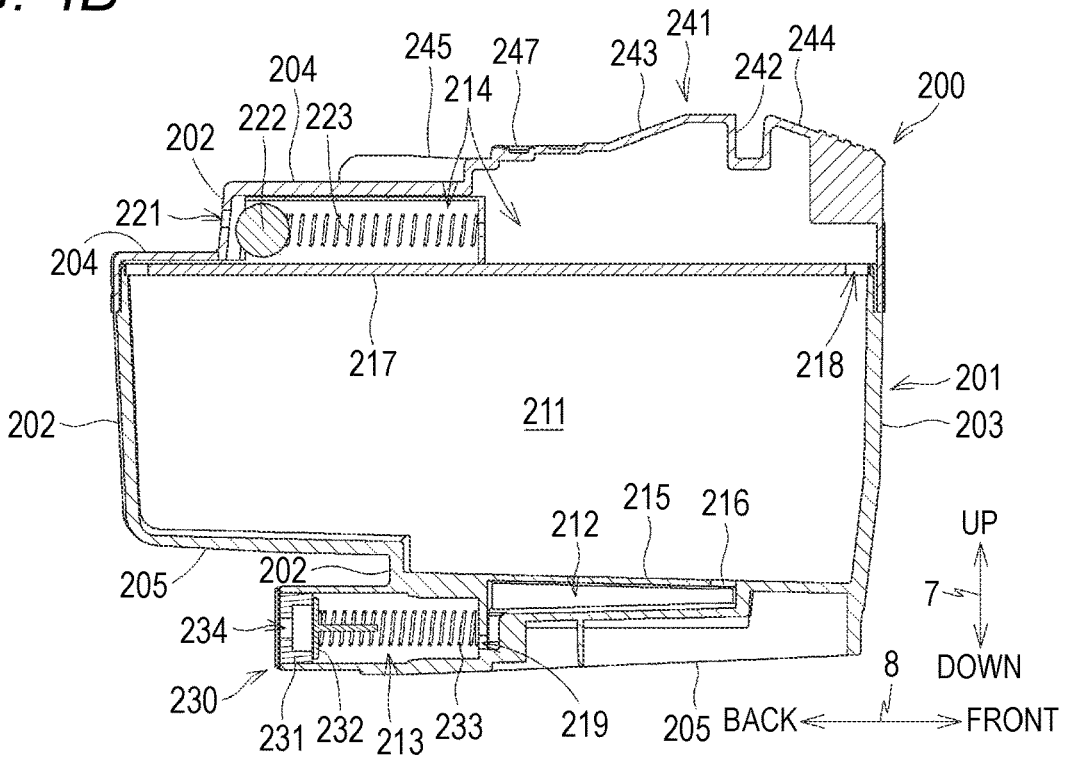
FIG. 4B is a longitudinal sectional view of the cartridge.

In the internal space of the cartridge 200, as illustrated in FIG. 4B, a liquid chamber 210, an ink valve chamber 213, and an air valve chamber 214 are formed. The liquid chamber 210 includes an upper liquid chamber 211 and a lower liquid chamber 212. The upper liquid chamber 211, the lower liquid chamber 212, and the air valve chamber 214 are internal spaces of the housing 201. On the other hand, the ink valve chamber 213 is an internal space of the supply tube 230. The liquid chamber 210 stores ink. The air valve chamber 214 allows the liquid chamber 210 and the outside of the cartridge 200 to communicate with each other. The liquid chamber 210 is an example of a first liquid chamber.

The upper liquid chamber 211 and the lower liquid chamber 212 of the liquid chamber 210 are separated from each other in the up and down direction 7 by a partition wall 215 that partitions the internal space of the housing 201. Then, the upper liquid chamber 211 and the lower liquid chamber 212 communicate with each other through a through hole 216 formed in the partition wall 215. In addition, the upper liquid chamber 211 and the air valve chamber 214 are separated from each other in the up and down direction 7 by a partition wall 217 that partitions the internal space of the housing 201. Then, the upper liquid chamber 211 and the air valve chamber 214 communicate with each other through a through hole 218 formed in the partition wall 217. Further, the ink valve chamber 213 communicates with a lower end of the lower liquid chamber 212 through a through hole 219.

The air valve chamber 214 communicates with the outside of the cartridge 200 through the air communication port 221 formed in the rear wall 202 at the upper part of the cartridge 200. That is, the air valve chamber 214 is which one end (through hole 218) communicates with the liquid chamber 210 (more specifically, the upper liquid chamber 211) and the other end (air communication port 221) communicates with the outside of the cartridge 200. The air valve chamber 214 communicates with the air through the air communication port 221. In addition, a valve 222 and a coil spring 223 are located in the air valve chamber 214. The valve 222 is movable between a closed position and an open position in the front and back direction 8. When being located at the closed position, the valve 222 closes the air communication port 221. Further, when being located at the open position, the valve 222 opens the air communication port 221. The coil spring 223 urges backward the valve 222 in a moving direction from the open position to the closed position, that is, the front and back direction 8.

The rod 153 enters the air valve chamber 214 through the air communication port 221 in the course of mounting the cartridge 200 on the installation case 150. The rod 153 having entered the air valve chamber 214 moves forward the valve 222 located at the closed position against an urging force of the coil spring 223. Then, as the valve 222 moves to the open position, the upper liquid chamber 211 communicates with the air. The configuration for opening the air communication port 221 is not limited to the above example. As another example, a configuration may be adopted in which the rod 153 breaks through a film that seals the air communication port 221.

The supply tube 230 protrudes backward from the rear wall 202 in the lower part of the housing 201. The protruding end (that is, a rear end) of the supply tube 230 is opened. That is, the ink valve chamber 213 allows the liquid chamber 210 communicating through the through hole 219 and the outside of the cartridge 200 to communicate with each other. The ink valve chamber 213 is an example of a flow path in which one end (through hole 219) communicates with the liquid chamber 210 (more specifically, the lower liquid chamber 212) and the other end (an ink supply port 234 which will be described below) communicates with the outside of the cartridge 200. In the ink valve chamber 213, a packing 231, a valve 232, and a coil spring 233 are located.

At the center of the packing 231, an ink supply port 234 penetrating in the front and back direction 8 is formed. An inner diameter of the ink supply port 234 is slightly smaller than an outer diameter of the needle 181. The valve 232 is movable between a closed position and an open position in the front and back direction 8. When being located at the closed position, the valve 232 comes in contact with the packing 231 and closes the ink supply port 234. Further, when being located at the open position, the valve 232 separates from the packing 231 and opens the ink supply port 234. The coil spring 233 urges backward the valve 232 in a moving direction from the open position to the closed position, that is, the front and back direction 8. In addition, the urging force of the coil spring 233 is larger than that of the coil spring 186.

The supply tube 230 enters the guide 182 in the course of installing the cartridge 200 on the installation case 150, and the needle 181 eventually enters the ink valve chamber 213 through the ink supply port 234. At this time, the needle 181 makes liquid-tight contact with the inner peripheral surface defining the ink supply port 234 while elastically deforming the packing 231. When the cartridge 200 is further inserted into the installation case 150, the needle 181 moves forward the valve 232 against an urging force of the coil spring 233. In addition, the valve 232 moves backward the valve 185 protruding from the opening 183 of the needle 181 against the urging force of the coil spring 186.

Figure 5:
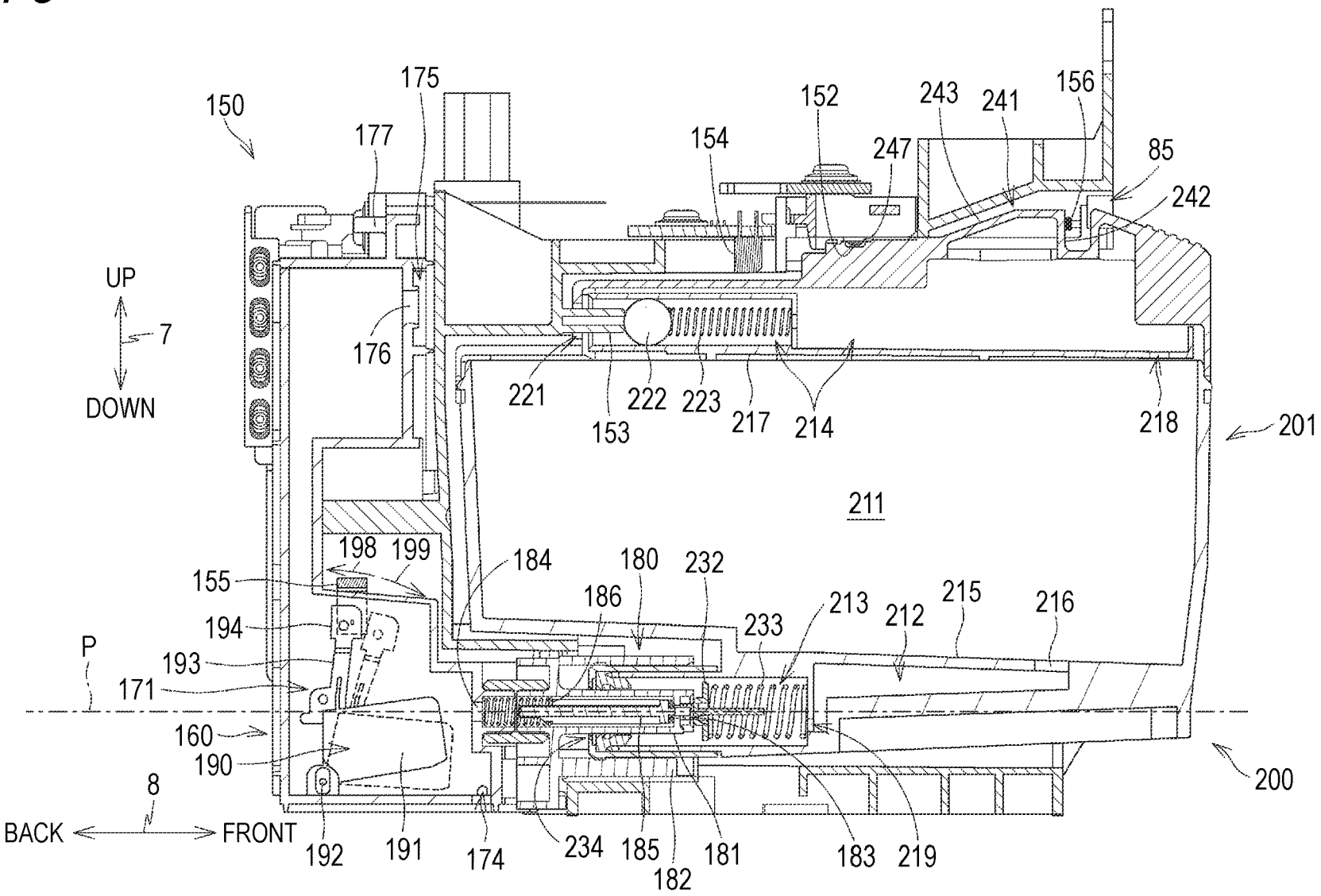
FIG. 5 is a longitudinal sectional view illustrating a state where the cartridge is installed in the installation case.

Thus, as illustrated in FIG. 5, the ink supply port 234 and the opening 183 are opened, and the ink valve chamber 213 of the supply tube 230 communicates with the internal space of the needle 181. That is, in the state where the cartridge 200 is installed in the installation case 150, the ink valve chamber 213 and the internal space of the needle 181 form a flow path through which the liquid chamber 210 of the cartridge 200 communicates with the liquid chamber 171 of the tank 160.

In the state where the cartridge 200 is installed in the installation case 150, a part of the liquid chamber 210 and a part of the liquid chamber 171 overlap each other when viewed in the horizontal direction. As a result, the ink stored in the liquid chamber 210 moves to the liquid chamber 171 of the tank 160 due to a water head difference through the connected supply tube 230 and the joint 180.

As illustrated in FIG. 4, a projection 241 is formed on the upper wall 204. The projection 241 protrudes upward from the outer surface of the upper wall 204 and extends in the front and back direction 8. The projection 241 includes a lock surface 242 and an inclined surface 243. The lock surface 242 and the inclined surface 243 are located above the upper wall 204. The lock surface 242 is directed to the front side in the front and back direction 8 and extends in the up and down direction 7 and the left and right direction 9 (that is, being substantially orthogonal to the upper wall 204). The inclined surface 243 is inclined with respect to the upper wall so as to be directed upward in the up and down direction 7 and backward in the front and back direction 8.

The lock surface 242 is a surface to be brought into contact with the lock pin 156 in the state where the cartridge 200 is installed in the installation case 150. The inclined surface 243 is a surface for guiding the lock pin 156 to a position where the lock pin comes in contact with the lock surface 242 in the course of installing the cartridge 200 on the installation case 150. In the state where the lock surface 242 and the lock pin 156 are in contact with each other, the cartridge 200 is held at the installation position illustrated in FIG. 5 against the urging force of the coil springs 186, 223, and 233.

A flat plate-like member is formed in front of the lock surface 242 so as to extend upward from the upper wall 204. An upper surface of the flat plate-like member corresponds to an operation portion 244 to be operated by a user when the cartridge 200 is removed from the installation case 150. When the cartridge 200 is installed in the installation case 150 and the cover 87 is located at the exposing position, the operation portion 244 can be operated by the user. When the operation portion 244 is pushed downward, the cartridge 200 rotates, and thus the lock surface 242 moves downward from the lock pin 156. As a result, the cartridge 200 can be removed from the installation case 150.

The light shielding rib 245 is formed on the outer surface of the upper wall 204 and behind the projection 241. The light shielding rib 245 protrudes upward from the outer surface of the upper wall 204 and extends in the front and back direction 8. The light shielding rib 245 is formed of a material or color that shields the light output from the light emitting portion of the installation sensor 154. The light shielding rib 245 is located on an optical path extending from the light emitting portion to the light receiving portion of the installation sensor 154 in the state where the cartridge 200 is installed in the installation case 150. That is, the installation sensor 154 outputs a low-level signal to the controller 130 when the cartridge 200 is installed in the installation case 150. On the other hand, the installation sensor 154 outputs a high-level signal to the controller 130 when the cartridge 200 is not installed in the installation case 150. That is, the controller 130 can detect whether the cartridge 200 is installed in the installation case 150, depending on a signal output from the installation sensor 154.

An IC substrate 247 is located on the outer surface of the upper wall 204 and between the light shielding rib 245 and the projection 241 in the front and back direction 8. On the IC substrate 247, an electrode 248 is formed. In addition, the IC substrate 247 includes a memory (not illustrated). The electrode 248 is electrically connected to the memory of the IC substrate 247. The electrode 248 is exposed on an upper surface of the IC substrate 247 so as to be electrically connectable with the contact 152. That is, the electrode 248 is electrically connected to the contact 152 in the state where the cartridge 200 is installed in the installation case 150. The controller 130 can read information from the memory of the IC substrate 247 through the contact 152 and the electrode 248, and can write information to the memory of the IC substrate 247 through the contact 152 and the electrode 248. The memory of the IC substrate 247 is an example of the cartridge memory.

The memory of the IC substrate 247 stores an ink amount Vc and identification information for identifying the individual of the cartridge 200. An initial ink amount Vc0 is stored, as the ink amount Vc, in the memory of the IC substrate 247 of a new cartridge 200. The initial ink amount Vc0 is an example of the initial liquid amount indicating the maximum amount of ink that can be stored in the cartridge 200. In other words, the initial ink amount Vc0 indicates the amount of ink stored in the new cartridge 200. Hereinafter, information stored in the memory of the IC substrate 247 may be collectively referred to as "CTG information" in some cases. Further, the "new" is a so-called unused item and indicates a state in which the ink stored in the cartridge 200 has never flowed out from the cartridge 200 which is manufactured and sold.

A storage region of the memory of the IC substrate 247 includes, for example, a region where information is not overwritten by the controller 130 and a region where information can be overwritten by the controller 130. For example, identification information is stored in the non-overwritable region that is not overwritten, and the ink amount Vc is stored in the overwritable region.

(Controller)

As illustrated in FIG. 6, the controller 130 includes a CPU 131, a ROM 132, a RAM 133, an EEPROM 134, and an ASIC 135. The ROM 132 stores various programs that allow the CPU 131 to control various operations. The RAM 133 is used as a storage region which temporarily records data or signals to be used when the CPU 131 executes the programs or a work region where data is processed. The EEPROM 134 stores setting information which should be retained even after the power is turned off. The ROM 132, the RAM 133, and the EEPROM 134 are examples of memories.

The ASIC 135 is used to operate the feed roller 23, the conveyance roller 25, the discharge roller 27, and the head 21. The controller 130 rotates the feed roller 23, the conveyance roller 25, and the discharge roller 27 by driving a motor (not illustrated) through the ASIC 135. In addition, the controller 130 outputs a driving signal to a driving element of the head 21 through the ASIC 135, thereby causing the head 21 to discharge ink through the nozzle 29. The ASIC 135 can output a plurality types of driving signals depending on the amount of ink to be discharged through the nozzle 29.

Further, a display 17 and an operation panel 22 are connected to the ASIC 135. The display 17 is a liquid crystal display, an organic EL display, or the like, and includes a display screen on which various types of information are displayed. The display 17 is an example of an alarm. However, specific examples of the alarm are not limited to the display 17, and may include a speaker, an LED lamp, or a combination thereof. The operation panel 22 outputs an operation signal corresponding a user's operation to the controller 130. For example, the operation panel 22 may include a push button, or may include a touch sensor overlaid on the display 17.

Further, the ASIC 135 is connected with the contact 152, the cover sensor 88, the installation sensor 154, and the liquid level sensor 155. The controller 130 accesses the memory of the IC substrate 247 of the cartridge 200 installed in the installation case 150 through the contact 152. The controller 130 detects the position of the cover 87 through the cover sensor 88. In addition, the controller 130 detects insertion and removal of the cartridge 200 through the installation sensor 154. Further, the controller 130 detects through the liquid level sensor 155 whether the liquid level of the ink stored in the liquid chamber 171 is equal to or higher than the predetermined position P.

When liquid level sensor 155 outputs a high-level signal, the ROM 132 stores a predetermined ink amount Vsc stored in the liquid chamber 171 of the tank 160 and a predetermined ink amount Vcc stored in the liquid chamber 210 of the cartridge 200. The predetermined ink amount Vcc is zero in the exemplary embodiment.

The EEPROM 134 stores various types of information in correlation with four cartridges 200 installed in the installation case 150, namely, in correlation with the tanks 160 communicating with the cartridges 200. The various types of information includes, for example, ink amounts Vc and Vs which are examples of the liquid amount, a function F, a C_Empty flag, an S_Empty flag, a temporary canceling flag, an in-tank non-residual amount flag, a count value SN, a count value TN, a threshold $N_{th1}$, a threshold $N_{th2}$.

The ink amount Vc and the identification information are information read by the controller 130 from the memory of the IC substrate 247 through the contact 152 in a state where the cartridge 200 is installed in the installation case 150. The function F may be stored in the ROM 132 instead of the EEPROM 134.

The ink amount Vc indicates the amount of ink stored in the liquid chamber 210 of the cartridge 200. The ink amount Vs indicates the amount of ink stored in the liquid chamber 171 of the tank 160. The ink amounts Vc and Vs are calculated by the function F. The function F is information indicating a corresponding relation of the total amount Vt of ink, the ink amount Vc, and the ink amount Vc. The ink in the liquid chamber 210 of the cartridge 200 and the ink in the liquid chamber 171 of the tank 160 are in equilibrium in a state where positions in the vertical direction 7 of the liquid levels of the respective inks coincide with each other. That is, the movement of the ink between the liquid chamber 210 and the liquid chamber 171 is stopped. For example, the relation between the total amount Vt of ink and the ink amount Vs can be approximated by the function F. Accordingly, when the total amount Vt of ink is calculated, the ink amount Vs and the ink amount Vc are obtained. The ink amount Vs and the ink amount Vc are not limited to the form of the function F, and may be obtained by a table correlated with the total amount Vt.

The count value SN is a value equivalent to an ink discharge amount Dh (that is, the ink amount indicated by the driving signal) instructed to be discharged from the head 21 and is a value that is updated closer to the threshold $N_{th1}$, after the signal output from the liquid level sensor 155 changes from the low-level signal to the high-level signal. The count value SN is a value counted up with an initial value being "0". In addition, the threshold $N_{th1}$ is equivalent to a volume of the liquid chamber 171 between the vicinity of the upper end of the outflow port 174 and the predetermined position P. However, the count value SN may be a value counted down with a value equivalent to the volume as an initial value. In this case, the threshold $N_{th1}$ is zero (0).

The count value TN is a value equivalent to an ink discharge amount Dh (that is, the ink amount indicated by the driving signal) instructed to be discharged from the head 21 and is a value counted up with an initial value being "0", after the signal output from the liquid level sensor 154 changes from the high-level signal to the low-level signal. Further the count value TN may be a value counted down with a value equivalent to the total amount Vt of ink as an initial value.

The C_Empty flag is information indicating whether the cartridge 200 is in a cartridge empty state. In the C_Empty flag, a value "ON" corresponding to the cartridge empty state or a value "OFF" corresponding to non-cartridge empty state is set. The cartridge empty state is a state where ink is not substantially stored in the cartridge 200 (more specifically, the liquid chamber 210). In other words, the cartridge empty state is a state where ink does not move from the liquid chamber 210 to the liquid chamber 171 communicating with the cartridge 200. Namely, the cartridge empty state is a state where the liquid level of the tank 160 communicating with the cartridge 200 is lower than the predetermined position P.

The S_Empty flag is information indicating whether the tank 160 is in an ink empty state. In the S_Empty flag, a value "ON" corresponding to the ink empty state or a value "OFF" corresponding to non-ink empty state is set. The ink empty state is, for example, a state where the liquid level of the ink stored in the tank 160 (more specifically, the liquid chamber 171) reaches the position of the upper end of the outflow port 174. In other words, the ink empty state is a state where the count value SN is equal to or larger than the threshold $N_{th1}$. When the ink is continuously discharged from the head 21 after the ink empty state, the liquid level of the ink in the tank 160 may fall below the upper end of the outflow port 174, and air may be mixed in an ink flow path from the tank 160 to the head 21 or in the head 21 (so called air-in). As a result, the inside of the nozzle 29 is filled with the ink, and the ink may not be discharged.

The non-residual-amount flag is information indicating whether the liquid level of the ink stored in the liquid chamber 171 of the tank 160 is descending to the upper end of the outflow port 174. When the liquid level of the ink stored in the liquid chamber 171 reaches a position near the upper end of the outflow port 174, the tank is in an ink empty state. The ink empty state is determined depending on whether the count value SN is equal to or larger than the threshold $N_{th1}$. In addition, the ink empty state is determined depending on whether the count value TN is equal to or larger than the threshold $N_{th1}$. However, the position of the liquid level of the ink stored in the liquid chamber 171 in the ink empty state is preferably set to be somewhat higher than the upper end of the outflow port 174 in consideration of the error of the count value TN, SN and the position of the liquid level of the ink stored in the liquid chamber 171 due to the installation state (inclination from the horizontal) of a printer 10.

(Operation of Printer)

An operation of the printer 10 according to the exemplary embodiment will be described with reference to FIGS. 7 to 10. Each of processes illustrated in FIGS. 7 to 10 is executed by the CPU 131 of the controller 130. Each of the following processes may be executed by the CPU 131 reading programs stored in the ROM 132, or may be implemented a hardware circuit mounted on the controller 130. Further, execution orders of the following processes can be appropriately changed within the range of the scope of the disclosure.

(Image Recording Process)

Figure 7:
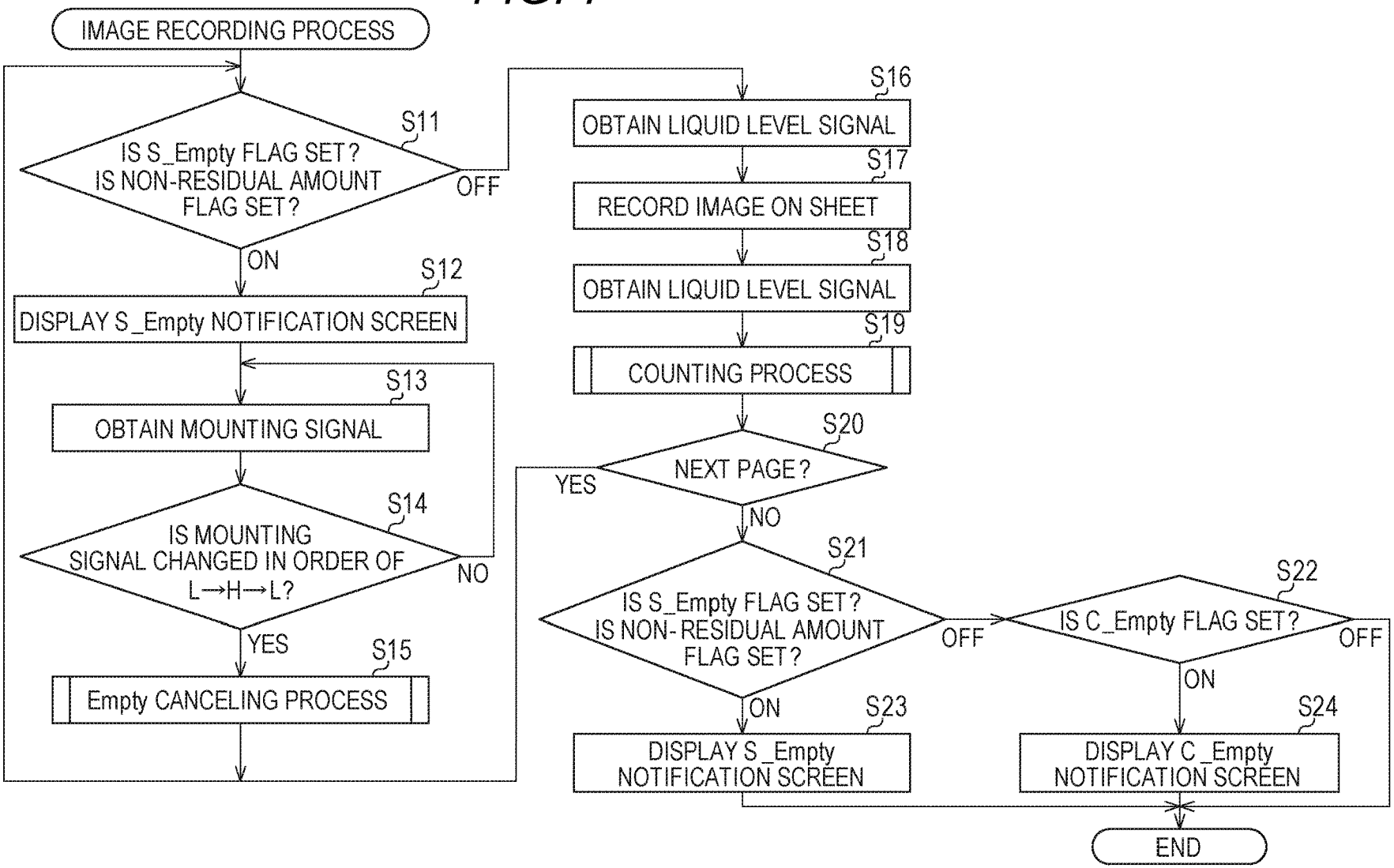
FIG. 7 is a flowchart of an image recording process.

The controller 130 executes an image recording process illustrated in FIG. 7 in response to a recording instruction being input to the printer 10. The recording instruction is an example of a discharge instruction for causing the printer 10 to execute a recording process of recording an image indicated by image data on a sheet. An acquisition destination of the recording instruction is not particularly limited, but, for example, a user's operation corresponding to the recording instruction may be received through the operation panel 22 or may be received from an external device through a communication interface (not illustrated).

First, the controller 130 determines set values of four S_Empty flags and the non-residual-amount flag (S11). Then, the controller 130 displays an S_Empty notification screen on the display 17 in response to determining that at least one of the four S_Empty flags is set to "ON" (S11: ON) (S12). The S_Empty notification screen is a screen for notifying the user that the corresponding tank 160 is in the ink empty state and the ink cannot be discharged through the head 21. In addition, the ink empty state is a state in which any one of the S_Empty flag or the non-residual-amount flag is "ON". For example, the S_Empty notification screen may include information relating to the color and the ink amounts Vc and Vs of the ink stored in the tank 160 being in the ink empty state. In step S12, the controller 130 may display the C_Empty notification screen on the display 17 together with the S_Empty notification screen in response to determining that at least one of the four C_Empty flags is set to "ON". The operation of the display 17 in S12 is an example of a first operation.

In addition, the controller 130 executes processes S13 to S15 for each the cartridge 200 corresponding to the S_Empty flag set to "ON". That is, the processes is executed for each the cartridge 200 among the four cartridges 200 in which the S_Empty flag is set to "ON". Since the processes S13 to S15 for each the cartridge 200 is common, only the processes S13 to S15 corresponding to one cartridge 200 will be described.

First, the controller 130 obtains a signal output from the mounting sensor 154 (S13). Next, the controller 130 determines whether the signal obtained from the mounting sensor 154 is a high-level signal or a low-level signal (S14). Then, the controller 130 repeatedly executes the processes S13 and S14 at predetermined time intervals until the signal output from the mounting sensor 154 changes into the high-level signal from the low-level signal and changes into the low-level signal from the high-level signal again (S14: No). In other words, the controller 130 repeatedly executes the processes S13 and S14 until the cartridge 200 is removed from the installation case 150 and a new cartridge 200 is installed in the installation case 150.

Then, the controller 130 executes an Empty canceling process (S15) in response to obtain the low-level signal from the mounting sensor 154, and obtain the high-level signal from the mounting sensor 154, and then obtain the low-level signal from the mounting sensor 154 (S14: Yes). The Empty canceling process is a process of deleting the C_Empty notification screen and the S_Empty notification screen displayed on the display 17. The details of the Empty canceling process will be described with reference to FIG. 9. Then, the steps subsequent to S11 are executed again in response to the completion of the Empty canceling process.

The controller 130 obtains signals output from four liquid level sensors 155 at the present time when all the S_Empty flags corresponding to all the cartridges 200 are not "ON", that is, are "OFF" (S16). In S16, the controller 130 further causes the RAM 133 to store information indicating whether the signal obtained from the liquid level sensor 155 is a high-level signal or a low-level signal.

Then, the controller 130 records the image indicated by the image data included in the recording instruction on the sheet (S17). More specifically, the controller 130 causes the sheet on the feed tray 15 to be conveyed to the feed roller 23 and the conveyance roller 25, causes the head 21 to discharge the ink, and causes the sheet, on which the image is recorded, to be discharged to the discharge roller 27 via the discharge tray 16. That is, the controller 130 permits the discharge of the ink through the head 21 when all of the four S_Empty flags are set to "OFF". Meanwhile, the controller 130 prohibits the discharge of the ink through the head 21 when at least one of the four S_Empty flags or the non-residual-amount flag is set to "ON".

Next, the controller 130 obtains signals output from the four liquid level sensors 155 at the present time in response to recording the image on one sheet according to the recording instruction (S18). Further, similarly to step S17, the controller 130 causes the RAM 133 to store information indicating whether the signal obtained from the liquid level sensor 155 is a high-level signal or a low-level signal (S18). Then, the controller 130 executes a counting process (S19). The counting process is a process of updating the count values TN and SN, the C_Empty flag, the S_Empty flag and the non-residual-amount flag based on the signal obtained from the liquid level sensor 155 in steps S17 and S19. Details of the counting process will be described below with reference to FIG. 8.

Next, the controller 130 repeatedly executes the processes S11 to S19 until all the images indicated by the recording instruction are recorded on the sheet (S20: Yes). Then, the controller 130 determines set values of the four S_Empty flags and set values of the four C_Empty flags and the non-residual-amount flag in response to recording all the images indicated by the recording instruction on the sheet (S20: No) (S21 and S22).

When at least one of the four S_Empty flags and the non-residual-amount flag is set to "ON" (S21: ON), the controller 130 displays the S_Empty notification screen on the display 17 (S23). In addition, when all of the four S_Empty flags and the non-residual-amount flag are set to "OFF" and at least one of the four C_Empty flags is set to "ON" (S21: OFF & S22: ON), the controller 130 displays the C_Empty notification screen on the display 17 (S24).

The S_Empty notification screen displayed in step S23 may be the same as in step S12. In addition, the C_Empty notification screen is a screen for notifying the user that the cartridge 200 corresponding to the C_Empty flag set to "ON" has entered the cartridge empty state. For example, the C_Empty notification screen may include information related to the color and the ink amounts Vc and Vs of the ink stored in the cartridge 200 being in the cartridge empty state. On the other hand, when all of the four S_Empty flags and the non-residual-amount flag and the four C_Empty flags are set to "OFF" (S22: OFF), the controller 130 completes the image recording process without executing the processes S23 and S24.

A specific example of the discharge instruction is not limited to the recording instruction, but may be a maintenance instruction instructing maintenance of the nozzle 29 such as a purge. For example, the controller 130 executes the same processes as in FIG. 7 in response to obtaining the maintenance instruction through the operation panel 22. Differences from the above-described processes in the case of obtaining the maintenance instruction are as follows. First, the controller 130 drives a maintenance mechanism (not illustrated) in step S17, and discharges the ink through the nozzle 29. In addition, the controller 130 executes the processes of step S21 and the subsequent steps without executing step S20 after executing the counting process.

(Counting Process)

Next, details of the counting process executed by the controller 130 in S20 will be described with reference to FIG. 8. The controller 130 independently executes the counting process with respect to each of the four cartridges 200. Since the counting process is common for each cartridge 200, only the counting process corresponding to one cartridge 200 will be described.

First, the controller 130 compares information indicating the signals of the liquid level sensors 155 stored in the RAM 133 in S16 and S18 with one another (S31). That is, the controller 130 determines a change in the signal of each of the four liquid level sensors 155 before and after the process of S17 is executed immediately before the counting process (S19) is executed.

The controller 130 executes the residual amount updating process in response to the fact (S31: L→L) that the information stored in the RAM 133 in steps S16 and S18 indicates the low-level signal (that is, there is no change in the output of the liquid level sensors 155 before and after the process of S17) (S32). That is, the controller 130 counts up the count value TN which is a value equivalent to the amount of ink instructed to be discharged in the previous step S17.

In addition, the controller 130 calculates the current total amount Vt (S33). Specifically, the controller 130 calculates the total amount Vt of the exchanged cartridge which is the sum of the ink amount Vc and the ink amount Vs stored in the EEPROM 134 after exchange of the cartridge. Then, the controller 130 calculates the current total amount Vt (Vt=Vt−TN) which is a value obtained by subtracting the ink amount equivalent to the count value TN from the calculated total amount Vt. Then, the controller 130 obtains the ink amounts Vc and Vs based on the calculated current total amount Vt and the function F (S33).

Then, the controller 130 displays either one of both the obtained ink amount Vc and the ink amount Vs and the obtained total amount Vt on the display 17 (S34). Further, the controller 130 updates the obtained ink amount Vc with the ink amount Vc stored in the memory of the IC substrate 247 of the cartridge 200 (S35).

Next, the controller 130 compares the count value TN updated in step S32 with the threshold value $N_{th2}$ (S36). When it is determined that the count value TN updated in step S32 is smaller than the threshold value $N_{th2}$ (S36: No), the controller 130 ends counting process. On the other hand, when it is determined that the count value TN updated in step S32 is equal to or more than the threshold value $N_{th2}$ (S36: Yes), the controller 130 puts "ON" into the non-residual-amount flag (S37).

As will be described below, the threshold $N_{th2}$ is used to determine that the total amount Vt, which is a sum of the ink amount Vc stored in the liquid chamber 210 of the cartridge 200 and the ink amount Vs stored in the liquid chamber 171 of the tank 160 is an amount equivalent to a volume just below the outflow port 174 in the liquid chamber 171. If the liquid level sensor 155 normally functions, when the output of the liquid level sensor 155 is a low-level signal, the count value TN never becomes equal to or higher than the threshold $N_{th2}$. However, when the liquid level sensor 155 does not normally function or the actuator 190 does not normally function, the count value TN may be equal to or higher than the threshold $N_{th2}$ even when the output of the liquid level sensor 155 is a low-level signal. When the count value TN is equal to or higher than the threshold $N_{th2}$, it is estimated that the liquid level of the liquid chamber 171 is near the upper end of the outflow port 174. Therefore, the controller 130 sets the non-residual-amount flag to "ON" to prohibit the discharge of ink through the head 21, and displays the S_Empty notification screen on the display 17.

Figure 10A:
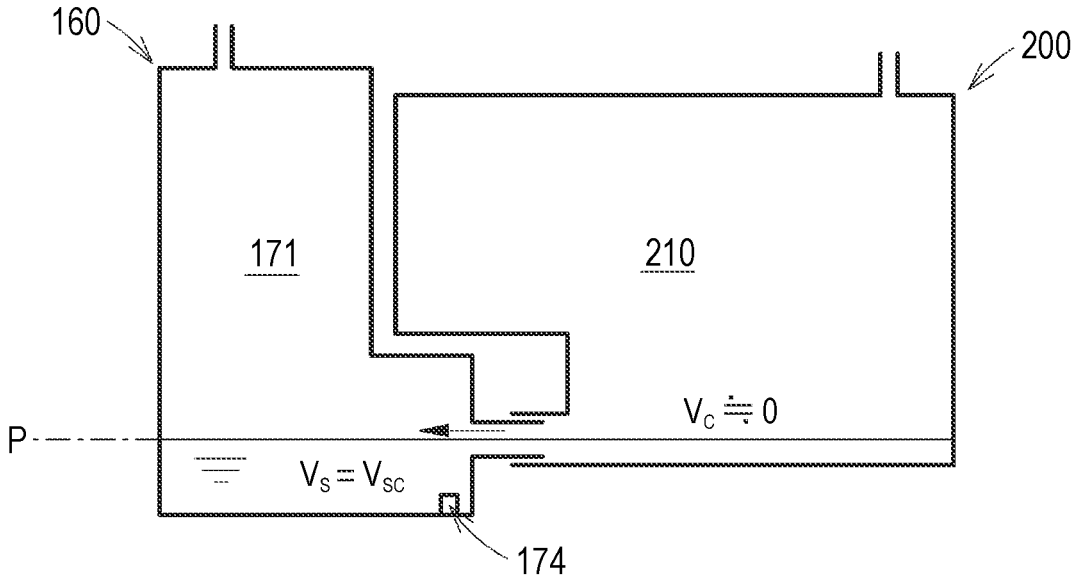
FIG. 10A is a schematic view illustrating a state where a cartridge communicates with a tank and illustrates a state where a cartridge is empty.

Further, the controller 130 puts "ON" into the C_Empty flag in response to the fact (S31: L→H) that the information stored in the RAM 133 in S17 indicates the low-level signal and the information stored in the RAM 133 in S19 indicates the high-level signal (that is, there is no change in the output of the liquid level sensors 155 before and after the process of S17) (S38). The change from the low-level signal into the high-level signal in the output of the liquid level sensors 155 corresponds to the fact that the liquid level of the liquid chamber 171 reaches the predetermined position P during the process of S17 as illustrated in FIG. 10A. Then, there is no ink movement between the cartridge 200 and the tank 160. That is, the liquid level of the liquid chamber 210 and the liquid level of the liquid chamber 171 are a balance status.

In addition, the controller 130 reads a predetermined ink amount Vcc (=0) from the ROM 132, and sets the ink amount Vc to the predetermined ink amount Vcc (S39). Similarly, the controller 130 reads a predetermined ink amount Vsc (corresponding to the volume of the liquid chamber 171 below the predetermined position P) from the ROM 132, and sets the ink amount Vs to the predetermined ink amount Vsc (S39). Since the ink amounts Vc and Vs calculated in the residual amount updating process include errors, the controller 130 sets the ink amount Vc to the predetermined ink amount Vcc at the timing when the output of the liquid level sensor 155 changes from the low-level signal to the high-level signal, and sets the ink amount Vs to the predetermined ink amount Vsc, thereby resetting the accumulated errors. Further, the controller 130 calculates the current total amount Vt as a value equal to the ink amount Vs (Vt=Vsc) (S39). As the ink amount Vc becomes zero, the total amount Vt has the same value as the ink amount Vs.

Then, the controller 130 displays either one of both the current ink amount Vc and the ink amount Vs and the current total amount Vt on the display 17 (S40). In addition, the controller 130 overwrites the above-described ink amount Vc (=0) with the ink amount Vc stored in the memory of the IC substrate 247 of the cartridge 200 (S41).

Since the change in the output of the liquid level sensors 155 is in the middle of the process of S17, the predetermined ink amount Vsc read in step S39 is not strictly the amount of ink stored in the tank 160 at the moment the output of the liquid level sensor 155 changes, but indicates the amount of ink immediately before the output of the liquid level sensor 155 changes. However, since the difference in the ink amount is small, the predetermined ink amount Vsc read in step S39 is approximately treated as the ink amount Vs at the time when the output of the liquid level sensor 155 changes.

In addition, the controller 130 counts up the count value SN stored in EEPROM 134 with the value corresponding to the amount of ink instructed to be discharged in the immediately previous step S17 (S42). In other words, the controller 130 starts to update the count value SN in response to the change from the low-level signal into the high-level signal in the output of the liquid level sensors 155. The controller 130 counts up the count value TN stored in the EEPROM 134 with a value corresponding to the amount of ink instructed to be discharged in the immediately previous step S17.

Then, the controller 130 calculates the ink amount Vs (S43). The calculated ink amount Vs is a value obtained by subtracting from the ink amount corresponding to the count value SN stored in the EEPROM 134 from the ink amount Vsc stored in the ROM 132. As described above, after the output of the liquid level sensor 155 becomes the high-level signal, the ink amount Vs is the same value as the total amount Vt. In addition, the ink amount Vc is zero.

Then, the controller 130 displays either one of both the obtained current ink amount Vc and the ink amount Vs and the current total amount Vt on display 17 (S44). Since the ink amount Vc is zero after the output of liquid level sensor 155 becomes the high-level signal, the controller 130 does not need to update the ink amount Vc stored in the memory of the IC substrate 247 of the cartridge 200.

Next, the controller 130 compares the count value SN updated in step S42 with the threshold value $N_{th1}$ (S45). When it is determined that the count value SN updated in step S42 is smaller than the threshold value $N_{th1}$ (S45: No), the controller 130 ends counting process. On the other hand, when it is determined that the count value SN updated in step S42 is equal to or more than the threshold value $N_{th1}$ (S45: Yes), the controller 130 puts "ON" into the S_Empty flag (S46). Then, the controller 130 prohibits the discharge of the ink through the head 21 and completes the counting process when the S_Empty flag is set to "ON".

Furthermore, the controller 130 reads the count value SN stored in the EEPROM 134 in response to the fact (S31: H→H) that both information stored in the RAM 133 in steps S16 and S18 indicates the high-level signal. Then the controller 130 counts up the read count value SN with a value corresponding to the amount of ink instructed to be discharged in the immediately previous step S17 and stores the value in the EEPROM 134 again. That is, the controller 130 updates the count value SN (S42). The controller 130 also updates the count value TN. Next, the controller 130 executes the process from step S43 to step S46 described above using the count value SN updated in step S42.

(Empty Canceling Process)

Figure 9:
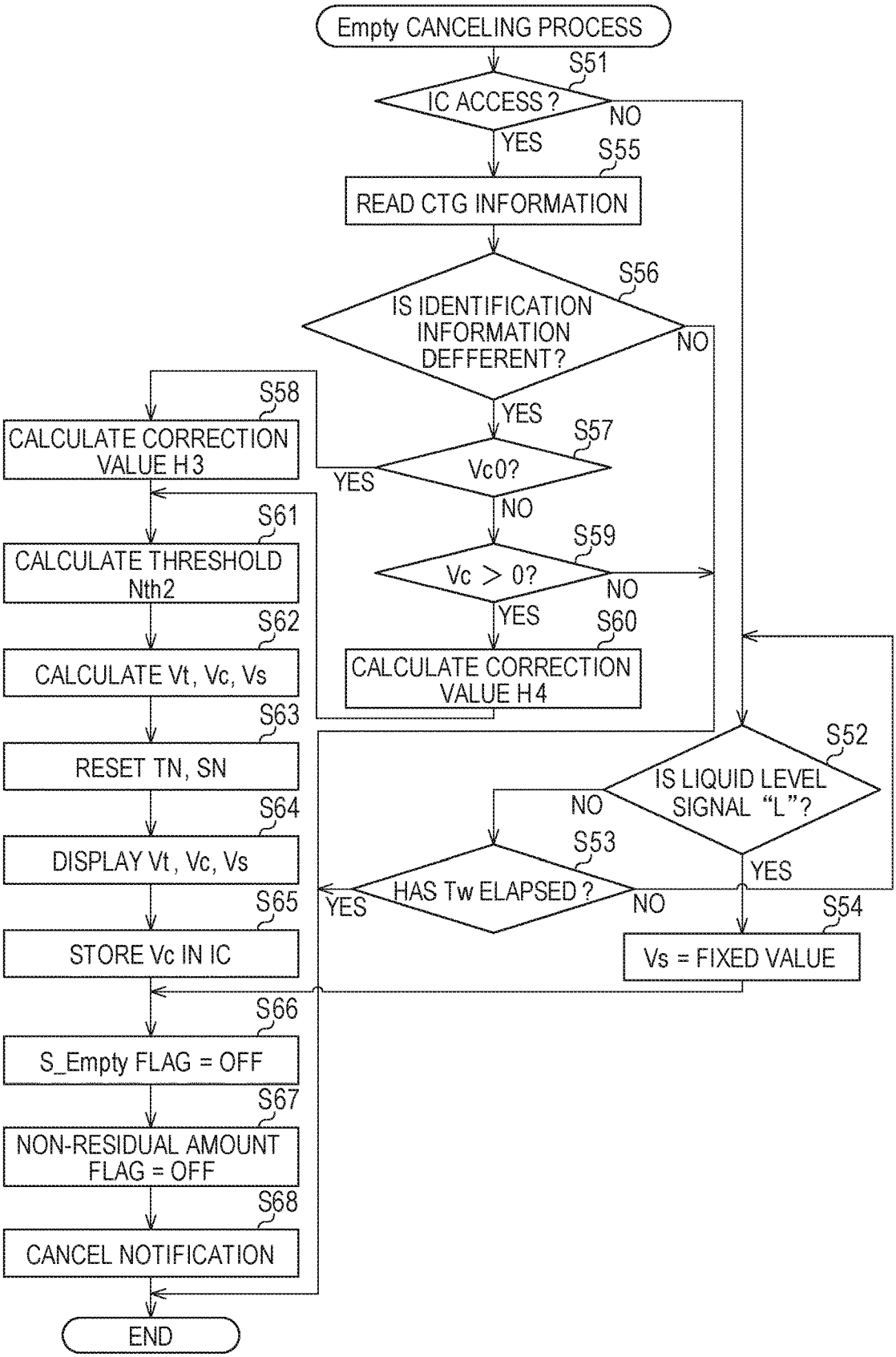
FIG. 9 is a flowchart of an Empty canceling process.

Next, with reference to FIG. 9, details of the Empty canceling process executed by the controller 130 in step S15 will be described. The controller 130 independently executes the Empty canceling process with respect to each of the four cartridges 200. Since the Empty canceling process is common for each cartridge 200, only the Empty canceling process corresponding to one cartridge 200 will be described.

Figure 8:
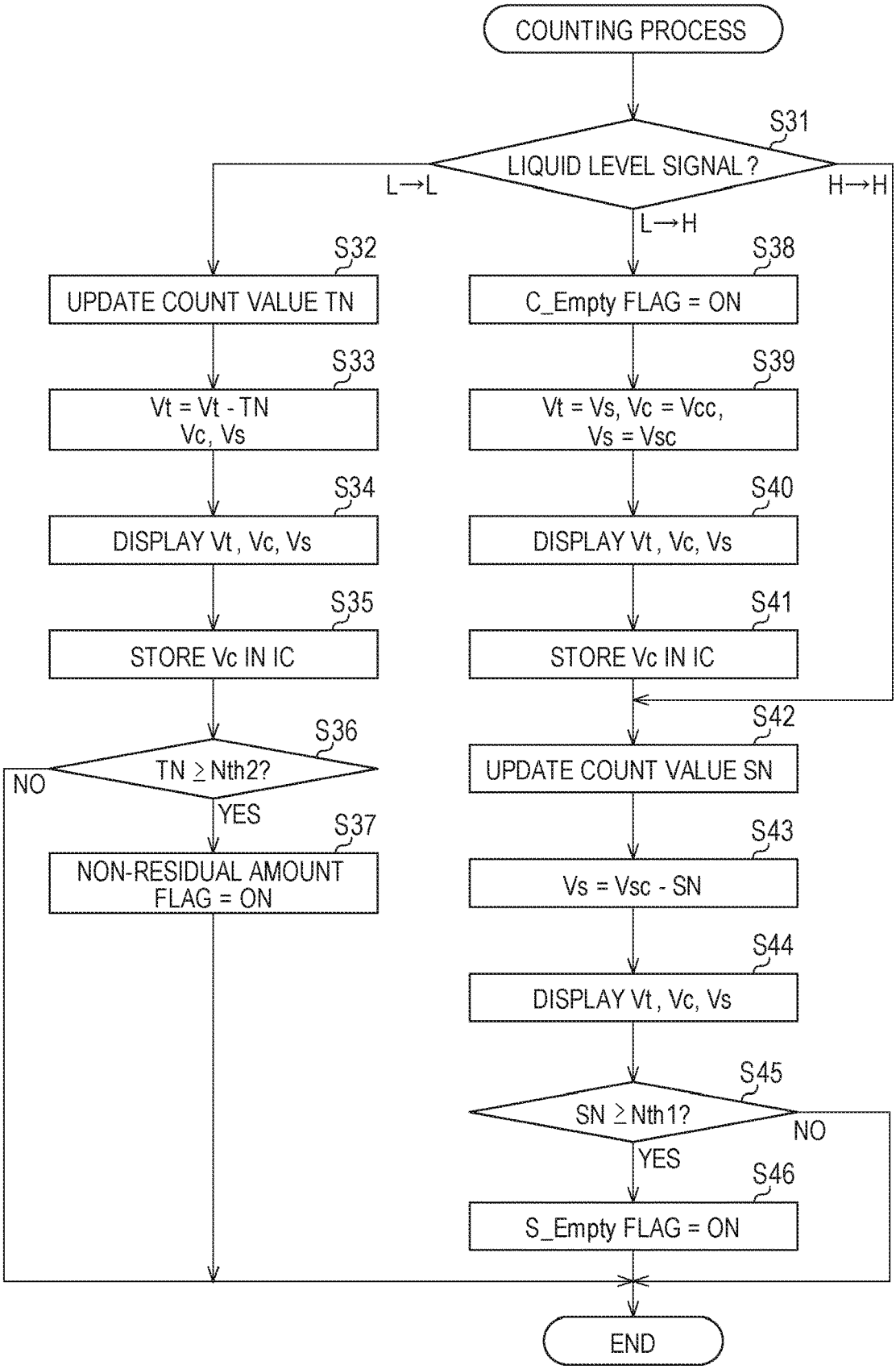
FIG. 8 is a flowchart of a counting process.

In the counting process illustrated in FIG. 8, when it is determined that the count value SN is equal to or more than the threshold value $N_{th1}$ (S45: Yes), the controller 130 puts "ON" into the S_Empty flag (S46). Further, when determining that the count value TN is equal to or more than the threshold value $N_{th2}$ (S36: Yes), the controller 130 puts "ON" into the non-residual-amount flag (S37). In the image recording process illustrated in FIG. 7, the controller 130 displays the S_Empty notification screen on the display 17 (S12) when determining that either one of the S_Empty flag and the non-residual-amount flag is set to "ON" (S11: ON). The controller 130 displays the S_Empty notification screen on the display 17, but prohibits the discharge of the ink through the head 21.

Figure 10B:
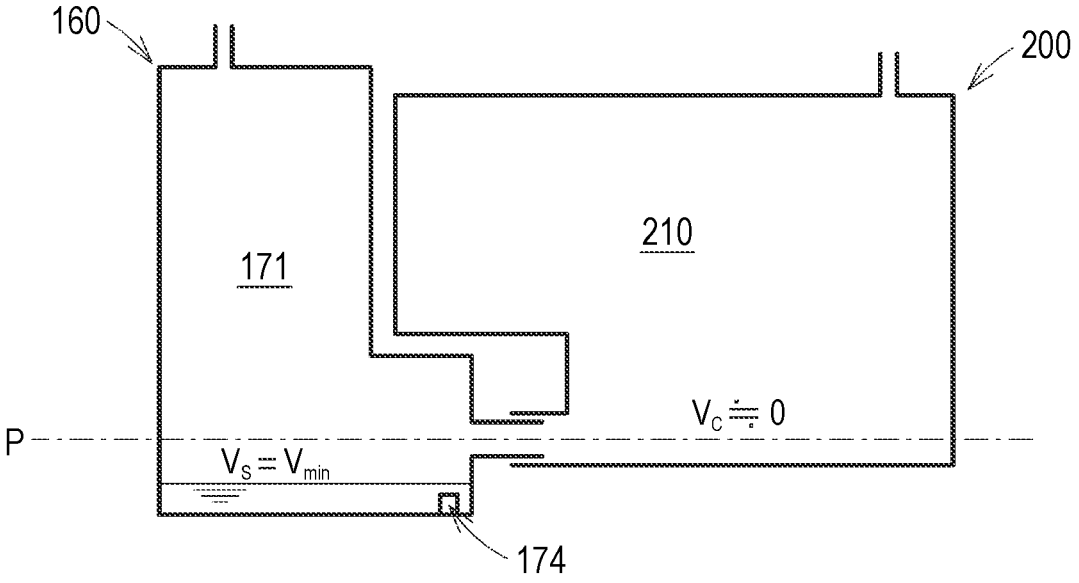
FIG. 10B is a schematic view illustrating a state where a cartridge communicates with a tank and illustrates a state where no residual amount exists in the tank.

In the above-described state (that is, a state where the controller 130 prohibits the ink from being discharged through the head 21 and displays the S_Empty notification screen on the display 17), as illustrated in FIG. 10B, the cartridge 200 is in a state where the ink does not flow toward the tank 160, that is, a state where the ink amount Vc is zero (Vc=0). In addition, the liquid level of the ink in the tank 160 is below the predetermined position P and reaches the position near the upper end of the outflow port 174. Accordingly, when the user does not release the prohibition of the discharge of ink through the head 21 by exchanging the cartridge 200 being in the empty state with a new cartridge or the cartridge 200 in which ink is fully stored, image recording cannot be executed.

In the course of exchanging the cartridge 200 by the user, the controller 130 obtains the low-level signal from the mounting sensor 154, then obtains the high-level signal from the mounting sensor 154, and further obtains the low-level signal from the mounting sensor 154 (S14: Yes). Specifically, in the course of removing the cartridge 200 from the installation case 150, the controller 130 obtains the low-level signal from the mounting sensor 154 and then obtains the high-level signal from the mounting sensor 154. Next, in the course of inserting the cartridge 200 into the installation case 150, the controller obtains the high-level signal from the mounting sensor 154 and then obtains the low-level signal from the mounting sensor 154.

In the Empty canceling process, the controller 130 determines whether access to the memory of the IC substrate 247 through the contact is possible 152 (S51). In a state where the information stored in the memory of the IC substrate 247 is not read, in a state where the ink amount Vc is difficult to be read, or in a state where an electric signal is not returned in the conduction check of the IC substrate 247, the controller 130 determines that access to the memory of the IC substrate 247 is impossible (S51: No).

When determining that the access to the memory of the IC substrate 247 is impossible (S51: No), the controller 130 determines whether the signal received from the liquid level sensor 155 is a low-level signal (S52). When determining that the signal received from the liquid level sensor 155 is not the low-level signal (S52: No), the controller 130 determines whether the elapsed time from when the low-level signal is received from the mounting sensor 154 elapses the predetermined time Tw (S53). When the cartridge 200 is installed in the installation case 150, ink flow into the liquid chamber 171 of the tank 160 from the liquid chamber 210 of the cartridge 200, and the liquid level of the liquid chamber 171 reaches the predetermined position P. The predetermined time Tw is set corresponding to the time required until the liquid level of the liquid chamber 171 reaches the predetermined position P from when the cartridge 200 is installed in the installation case 150.

When determining that the elapsed time from when receiving the low-level signal from the mounting sensor 154 does not reach the predetermined time Tw (S53: No), the controller 130 determines whether the signal received from the liquid level sensor 155 is a low-level signal (S52). The controller 130 terminates the Empty canceling process when determining that the elapsed time from when receiving the low-level signal from the mounting sensor 154 reaches the predetermined time Tw (S53: Yes). Even if the elapsed time from when receiving the low-level signal from the mounting sensor 154 reaches the predetermined time Tw, when the liquid level sensor 155 does not output the low-level signal, it is estimated as follows. That is, it is estimated that the amount of ink required for the liquid level of the liquid chamber 171 to reach the predetermined position P does not flow out from the liquid chamber 210 of the cartridge 200 installed in the installation case 150 into the liquid chamber 171 of the tank 160.

The controller 130 updates the ink amount Vs stored in the EEPROM 134 to a predetermined value (predetermined fixed value) (S54) when determining that the signal received from the liquid level sensor 155 is the low-level signal (S52: Yes). The predetermined value corresponds to the amount of ink stored in the liquid chamber 171, for example, when a new cartridge 200 is installed in the installation case 150 and the liquid level of the liquid chamber 210 and the liquid level of the liquid chamber 171 are in equilibrium. The predetermined value is stored in the ROM 132, for example. Then, the controller 130 executes step S65 to be described below.

When the access to the memory of the IC substrate 247 through the contact 152 is possible (S51: Yes), the controller 130 reads CTG information from the memory of the IC substrate 247 and stores the information in the EEPROM 134 (S55). If the exchanged cartridge 200 is new, the memory of the IC substrate 247 stores an initial ink amount Vc0 as the ink amount Vc.

Then, the controller 130 compares the identification information read from the memory of the IC substrate 247 and the identification information read from the memory of the IC substrate 247 of the cartridge 200 before exchange (S56). The identification information read from the memory of the IC substrate 247 of the cartridge 200 before exchange is stored in the EEPROM 134. For example, when the cartridge 200 is exchanged with a new cartridge 200, the compared two types of identification information are different. As the identification information, for example, a serial number of the cartridge 200 is used.

When it is determined that the compared two types of identification information are the same (S56: No), the controller 130 completes the Empty canceling process. Even when the cartridge 200 in which the ink amount Vc of the liquid chamber 210 becomes zero as the ink is consumed is mounted in the installation case 150 again, the ink does not move from the liquid chamber 210 of the cartridge 200 to the liquid chamber 171 of the tank 160 and thus Empty does not need to be canceled. When determining that the compared two types of identification information are different from each other (S56: Yes), the controller 130 executes step S57.

The controller 130 calculates correction amount H for correcting the threshold $N_{th2}$ based on the initial ink amount Vc0 (S58) when determining that the initial ink amount Vc0 is read as the ink amount Vc from the memory of the IC substrate 247 (S57: Yes). Specifically, first, the controller 130 determines a correction value H1 for the initial ink amount Vc0. The correction value H1 takes account of variations with respect to the initial ink amount Vc0. In the manufacturing step of the cartridge 200, ink is dispensed into the liquid chamber 210 of the cartridge 200 with the initial ink amount Vc0 as a design value. However, when the ink is dispensed into the liquid chamber 210 of the cartridge 200, there may be variations in the dispensing amount of ink. Therefore, the dispensing amount is set such that at least the initial ink amount Vc0 is dispensed into the liquid chamber 210 as the lower limit stored in the liquid chamber 210 in consideration of variations of dispensing, with respect to the design value of the initial ink amount Vc0. As a result, the dispensing amount is larger than the initial ink amount Vc0. The correction value H1 is set for the amount of liquid to be dispensed to a greater extend. The correction value H1 is stored in ROM 132, for example.

Subsequently, the controller 130 reads a predetermined ink amount Vsc from the ROM 132, and reads a count value SN from the EEPROM 134. An ink amount Vs (Vs=Vsc−SN) of the liquid chamber 171 is calculated from the read predetermined ink amount Vsc and count value SN. Then, a correction value H2 is calculated by multiplying the calculated ink amount Vs by a predetermined coefficient and multiplying the initial ink amount Vc0 by a predetermined coefficient. After exchange with a new cartridge 200, the ink amount, which is a sum of the ink amount Vs and the initial ink amount Vc0, can be discharged from the head 21. The count value TN is a value corresponding to the ink discharge amount Dh instructed to discharge to the head 21, but an error may occur between the ink discharge amount Dh instructed by the head 21 and the ink amount actually discharged from the head 21. In general, the ink amount actually discharged from the head 21 is smaller than the ink discharge amount Dh instructed by the head 21. The predetermined coefficient is a value (%) set corresponding to such an error. The correction value H2 is a sum of a discharge error with respect to the ink amount Vs and a discharge error with respect to the initial ink amount Vc0, and satisfies the following relation of correction value H2=predetermined coefficient×(Vs+Vc0). The predetermined coefficient is stored in the ROM 132, for example.

Then, the controller 130 calculates a correction value H3 which is a sum of the correction value H1 and the correction value H2, and causes the RAM 133 to store the value. That is, the relation is expressed by correction value H3=correction value H1+correction value H2. The controller 130 calculates a sum of the initial ink amount Vc0, the ink amount Vs, and the correction value H3, as the threshold $N_{th2}$, when the cartridge 200 is exchanged (S61). That is, the relation is expressed by threshold $N_{th2}$=Vc0+Vs+correction value H3. The ink amount Vmin, at which the liquid level of the liquid chamber 171 is located near the upper end of the outflow port 174 may be subtracted from the threshold $N_{th2}$.

In addition, the controller 130 determines whether the read ink amount Vc is greater than zero (S59) when determining that the ink amount Vc from the memory of the IC substrate 247 is not the initial ink amount Vc0 (S57: No). The controller 130 ends the Empty canceling process when the read ink amount Vc is zero (S59: No). Since the ink does not move from the liquid chamber 210 of the cartridge 200 to the liquid chamber 171 of the tank 160 even when the cartridge 200 having an ink amount of zero is installed in the installation case 150, it is not necessary to cancel the Empty.

When determining that the ink amount Vc is greater than zero (S59: Yes), the controller 130 calculates a correction value H4 for correcting the threshold $N_{th2}$, based on the read ink amount Vc (S60). Specifically, the controller 130 reads the predetermined ink amount Vsc from the ROM 132, reads the count value SN from the EEPROM 134, and calculates the ink amount Vs of the liquid chamber 171 from these values. Then, the calculated ink amount Vs is multiplied by the predetermined coefficient. The predetermined coefficient for calculation of the correction value H4 is the same as the predetermined coefficient for calculation of the correction value H2. In addition, the controller 130 multiplies ink amount Vc read from the memory of the IC substrate 247 by the predetermined coefficient. The correction value H4 is the sum of the discharge error with respect to the ink amount Vs and the discharge error with respect to the ink amount Vc, that is, correction value H4=predetermined coefficient×(Vs+Vc0). Then, the controller 130 stores the determined correction value H4 in the RAM 133. The controller 130 calculates the sum of the ink amount Vc, the ink amount Vs, and the correction value H4, as the threshold $N_{th2}$, when the cartridge 200 is exchanged. That is, the relation is expressed by threshold $N_{th2}$=Vc0+Vs+correction value H4. The ink amount Vmin, at which the liquid level of the liquid chamber 171 is located near the upper end of the outflow port 174 may be subtracted from the threshold $N_{th2}$.

Then, based on the calculated ink amount Vs and the ink amount Vc read from the memory of the IC substrate 247 of the exchanged cartridge 200, the controller 130 calculates a total amount Vt of the current ink and ink amounts Vc and Vs of the ink in the state where the ink has finished moving from the liquid chamber 210 of the cartridge 200 to the liquid chamber 171 of the tank 160 (S62). Specifically, the controller 130 reads the predetermined ink amount Vsc from the ROM 132, reads the count value SN from the EEPROM 134, and calculates the ink amount Vs of the liquid chamber 171 from these values. The ink amount in the liquid chamber 210 of the cartridge 200 read from the memory of the IC substrate 247 is the ink amount Vc. Therefore, the total amount Vt of the current ink is the sum of the ink amount Vs and the ink amount Vc. Further, from the total amount Vt of the current ink and the function F, the ink amount Vc and the ink amount Vs in the state where the ink has finished moving from the liquid chamber 210 to the liquid chamber 171.

The controller 130 resets the count values TN and SN stored in the EEPROM 134 after executing step S62 (S63). Thus, the count values TN and SN are respectively set to the initial values (herein, zero).

The controller 130 displays either one of the calculated ink amount Vc and ink amount Vs and the current total amount Vt on the display 17 (S64). The controller 130 stores the calculated ink amount Vc in the memory of the substrate 247 through the contact 152 (S65). The ink amount stored in the memory of the IC substrate 247 is updated from the initial ink amount Vc0, it is possible to determine that the cartridge 200 is not a new cartridge.

The controller 130 puts "OFF" into the S_Empty flag and the C_Empty flag, respectively (S66). The controller 130 puts "OFF" into the non-residual-amount flag (S67). The controller 130 allows the ink to be discharged through the head 21 when all of the four S_Empty flags and the non-residual-amount flag are set to "OFF". The controller 130 erases the S_Empty notification screen and the C_Empty notification screen from the display 17 (S68) and completes the Empty temporary canceling process.

According to the exemplary embodiment, since the S_Empty notification screen is displayed on the display 17 when the count value TN is equal to or more than the threshold $N_{th2}$, even if the liquid level sensor 155 breaks down, it is possible to notify the user that the ink amount Vs of the liquid chamber 171 is reduced. In addition, since the discharge of the liquid through the head 21 is prohibited when the count value TN that is equal to or more than the threshold $N_{th2}$, the air-in is prevented. The controller 13 may either display the S_Empty notification screen on the display 17 or prohibit the discharge of the ink through the head 21 when the count value TN is equal to or more than the threshold $N_{th2}$.

In addition, since the correction value H1 is set for the initial ink amount Vc0, the threshold $N_{th2}$ is calculate in consideration of dispensing variation corresponding to the initial ink amount Vc0 at the time of manufacturing.

Further, since the correction value H2 is calculated as a sum values obtained by multiplying the ink amount Vc and the ink amount Vs by the respective predetermined coefficients, the threshold $N_{th2}$ is calculate in consideration of variations in the count value TN.

In addition, after the cartridge 200 is exchanged, since S_Empty notification screen is erased from the display 17 when the compared identification information is different and the ink amount Vc read from the memory of the IC substrate 247 of the cartridge 200 is not zero, the S_Empty notification screen is erased if the cartridge is exchanged with a cartridge 200 in which ink stored in the liquid chamber 210

When the access to the memory of the IC substrate 247 of the exchanged cartridge 200 is impossible, it is possible to update ink amount Vs stored in the EEPROM 134 by simulating the amount of ink flowing into the liquid chamber 171 of the tank 160 from the liquid chamber 210 of the exchanged cartridge 200. This makes it possible to suppress the S_Empty notification screen from being displayed despite the fact that the threshold $N_{th2}$ becomes smaller when the cartridge 200 is subsequently exchanged and the ink is sufficiently left in the liquid chamber 171.

In addition, since the discharge of the ink through the head 21 is prohibited when the non-residual amount flag is "ON", the risk of air entering the head 21 from the liquid chamber 171 of the tank 160.

Modifications to Exemplary Embodiments

In the exemplary embodiment described above, when the ink amount Vc is greater than zero in S59 of the Empty canceling process, the S_Empty notification screen is erased in S67, but the S_Empty notification screen may be erased in S67 when the ink amount Vs calculated in S62 instead of S59 is larger than the ink amount at which the liquid level of the liquid chamber 171 is the predetermined position P or higher. Thus, when the cartridge is exchanged with the cartridge 200 in which the ink amount, at which the liquid level of the liquid chamber 171 is located above the predetermined position P, is stored in the liquid chamber. The screen indicated on the display 17 when the non-residual amount flag is "ON" may be different from the S_Empty notification screen. For example, a display suggesting the possibility of malfunction may be displayed on the display 17.

Further, the initial ink amount Vc0 stored as the ink amount Vc in the memory of the IC substrate 247 is, for example, the amount of ink stored initially in the cartridge having a large volume of the liquid chamber 210 or the amount of ink stored initially in the cartridge 200 having a standard volume of the liquid chamber 210. However, in addition to the ink amount Vc, a value of "1" or "0" corresponding to the amount of ink stored initially in the liquid chamber 210 may be stored, as information on the initial ink amount Vc0, in the memory of the IC substrate 247. For example, the initial ink amount corresponding to the information on the initial ink amount Vc0 is stored in the EEPROM 134, and the controller 130 may read the initial ink amount corresponding to the value, which is read from the memory of the IC substrate 247, from the EEPROM 134.

In the exemplary embodiment described above, the correction value H1 is a fixed value, but is not limited thereto. For example, the correction value H1 may be calculated by multiplying the initial liquid amount Vc0 read from the memory of the IC substrate 247 by the predetermined coefficient. In addition, the correction values H2 and H3 may be fixed values.

In the above-described exemplary embodiment, the discharge of ink through the head 21 is described as image recording on a sheet. However, the discharge of ink through the head 21 may be so-called purge in which the ink is forcibly discharged from the nozzle 29 of the head 21.

In the exemplary embodiment described above, the controller 130 detects, based on the signal output from the liquid level sensor 155, whether the detection target portion 194 of the actuator 190 is located at the detection position. However, the configuration of the liquid level sensor 155 is not particularly limited as long as the liquid level of the ink in the liquid chamber 171 can be detected. For example, the liquid level sensor 155 may be a sensor for optically detecting the liquid level of the ink in the liquid chamber 171 using a prism having a different reflectance depending on whether the ink is in contact with the rear wall 164 of the liquid chamber 171. Further, the liquid level sensor 155 may be an electrode bar inserted into the liquid chamber 171.

In the above-described exemplary embodiment, the controller 130 executes the process illustrated in step S15 in response to obtaining the low-level signal from the mounting sensor 154, then obtaining the high-level signal from the mounting sensor 154, and further obtaining the low-level signal from the mounting sensor 154 (S14: Yes). The controller 130 executes the process illustrated in step S15 when the cartridge 200 is mounted in the installation case 150 in which the cartridge 200 is not present in the installation case 150. That is, the controller 130 may execute the process illustrated in step S15 when determining that the cartridge 200 is mounted in the installation case 150. The fact that the controller 130 obtains the low-level signal from the mounting sensor 154, then obtains the high-level signal from the mounting sensor 154, and further obtains the low-level signal from the mounting sensor 154 is an example in which the controller 130 determines that the cartridge is mounted in the installation case 150. Other examples in which the controller 130 determines that the cartridge 200 is mounted in the installation case 150 will be described below.

For example, the controller 130 receives the low-level signal after receiving the high-level signal from the cover sensor 88. Then, the controller 130 reads the identification information from the memory of the IC substrate 247 and compares the read identification information with the identification information of the cartridge 200 before exchange stored in the EEPROM 134. When it is determined that the identification information read from the memory of the IC substrate 247 and the identification information stored in the EEPROM 134 are different from each other, the controller 130 may execute the process illustrated in step S15. That is, "the controller 130 reads identification information from the memory of the IC substrate 247 and compares the read identification information with the identification information of the cartridge 200 before exchange stored in the EEPROM 134. As a result, it is determined that the identification information read from the memory of the IC substrate 247 and the identification information stored in the EEPROM 134 are different from each other" is an example in which the controller 130 determines that the cartridge 200 is mounted in the installation case 150.

For example, the controller 130 receives the low-level signal after receiving the high-level signal from the cover sensor 88. Then, the controller 130 causes the user to display a confirmation screen indicating whether or not a new cartridge 200 is mounted in the installation case 150 through the display 17. The controller 130 receives an input corresponding to the confirmation screen through the operation panel 22 while the confirmation screen is being displayed on the display 17. The controller 130 executes the process illustrated in step S15 when the received input corresponds to the mounting of a new cartridge 200 in the installation case 150. That is, "the controller 130 receives the low-level signal after receiving the high-level signal from the cover sensor 88. Then, the controller 130 causes the user to display a confirmation screen indicating whether or not a new cartridge 200 is mounted in the installation case 150 through the display 17. The controller 130 receives an input corresponding to the confirmation screen through the operation panel 22 while the confirmation screen is being displayed on the display 17. The received input corresponds to the mounting of a new cartridge 200 in the installation case 150" is an example in which the controller 130 determines that the cartridge 200 is mounted in the installation case 150.

In addition, the IC substrate 247 is electrically connectable with the contact with the contact 152. However, an information medium and an interface for reading and writing data in a contactless manner using radio waves such as near field communication (NFC) or radio frequency identification (RFID) may be adopted.

Furthermore, in the exemplary embodiment described above, the ink is an example of liquid. However, the liquid, for example, may be pretreatment liquid discharged to a paper and the like prior to ink at the time of image recording, or may be water for cleaning the head 21.

As discussed above, the disclosure may provide at least the following illustrative, non-limiting embodiments.

(1) A liquid discharge device according to the disclosure comprises: an installation case configured to receive a cartridge, the cartridge comprising a first liquid chamber storing a liquid; a tank comprising a second liquid chamber; a flow path, one side of the flow path communicated with the second liquid chamber, and the other side of the flow path communicated with the first liquid chamber of the cartridge installed in the installation case; a head communicated with the second liquid chamber; a liquid level sensor; an interface; a memory; an alarm; and a controller configured to: receive, from the liquid level sensor, a first signal indicating that a position of a liquid level in the second liquid chamber is equal to or higher than a predetermined position; receive, from the liquid level sensor, a second signal indicating that the position of the liquid level in the second liquid chamber is lower than the predetermined position; determine whether the cartridge is installed in the installation case; based on determining that the cartridge is installed in the installation case, read a liquid amount Vc of a liquid stored in the first liquid chamber from a cartridge memory of the cartridge through the interface; read a liquid amount Vs of a liquid stored in the second liquid chamber from the memory; based on at least the liquid amount Vc read from the cartridge memory and the liquid amount Vs read from the memory, calculate a threshold, the threshold being equivalent to the position of the liquid level in the second liquid chamber which is lower than the predetermined position; receive a discharge instruction to discharge a liquid through the head; update a count value with a value equivalent to an amount of the liquid instructed to be discharged by the received discharge instruction; and operate the alarm in a case the updated count value reaches the threshold.

According to the above configuration, even if the liquid level sensor breaks down, it is possible to notify the user through the operation of the alarm that the liquid amount Vs of the second liquid chamber is reduced.

(2) Preferably, the controller is configured to: based on determining that the cartridge is installed in the installation case, read information indicating an initial liquid amount Vc0 of a liquid stored initially in the first liquid chamber, from the cartridge memory; based on the read information indicating the initial liquid amount Vc0, determine a correction value; and calculate the threshold by adding the read liquid amount Vc, the read liquid amount Vs, and the determined correction value to each other.

According to the above configuration, it is possible to the threshold in consideration of variations corresponding to the initial liquid amount Vc0 (discharging variation of the head or dispensing variation of the liquid into the first liquid chamber).

(3) Preferably, the controller is configured to calculate the correction value by multiplying a sum of the initial liquid amount Vc0 indicated by the read information and the read liquid amount Vs by a coefficient.

According to the above configuration, it is possible to calculate the threshold in consideration of variations in the count value.

(4) Preferably, the controller is configured to calculate the correction value by further adding a fixed value to the value obtained by multiplying the sum of the initial liquid amount Vc0 indicated by the read information and the read liquid amount Vs by the coefficient.

According to the above configuration, it is possible to calculate the threshold in consideration of variations in the initial liquid amount Vc0.

(5) Preferably, the controller is configured to: based on determining that the cartridge is installed in the installation case, read identification information stored in the cartridge memory through the interface from the cartridge memory of the cartridge installed in the installation case; store the read identification information in the memory; determine whether the cartridge is installed in the installation case at a predetermined time point from when the memory stores the identification information; based on determining that the cartridge is installed in the installation case, read identification information stored in the cartridge memory through the interface from the cartridge memory of the cartridge installed in the installation case at the predetermined time point; compare the identification information read from the cartridge memory with the identification information read from the memory; and in a case the compared identification information is different and the liquid amount Vc read from the cartridge memory is not zero, cancel the operation of the alarm.

According to the above configuration, when the cartridge in which the liquid is stored in the first liquid chamber is exchanged, the operation of the alarm is canceled.

(6) Preferably, the controller is configured to: determine a total liquid amount which is a sum of the liquid amount Vc read from the cartridge memory and the liquid amount Vs read from the memory; determine the liquid amount Vs of the second liquid chamber, from the determined total liquid amount when the liquid level of the first liquid chamber and the liquid level of the second liquid chamber are in equilibrium; and in a case the determined liquid amount Vs is larger than a liquid amount when the liquid level in the second liquid chamber is at the predetermined position, cancel the operation of the alarm.

According to the above configuration, the operation of the alarm is canceled when the cartridge is exchanged with a cartridge in which the ink amount, at which the liquid level in the second liquid chamber is located above the predetermined position, is stored in the first liquid chamber.

(7) Preferably, the controller is configured to: based on determining that the cartridge is installed in the installation case, access to the cartridge memory through the interface; and in a case the access to the cartridge memory through the interface is impossible, update the liquid amount Vs stored in the memory to a fixed value.

According to the above configuration, when the access to the cartridge memory of the exchanged cartridge is impossible, the liquid amount Vs can be updated by suggesting the amount of liquid flowing into the second liquid chamber from the first liquid chamber of the exchanged cartridge. Thus, when the cartridge is further exchanged afterwards, the threshold becomes small, and the operation of the alarm can be prevented despite the fact that the liquid is sufficiently left in the second liquid chamber.

The term "access is impossible" includes a state where the information stored in the cartridge memory cannot be read out, a state where the ink amount Vc is difficult to be read from the cartridge memory, or a state where an electric signal is not returned in the conduction check.

(8) Preferably, the controller is configured to prohibit the discharge of the liquid through the head when the updated count value reaches the threshold.

According to the above configuration, it is possible to reduce the risk of air entering the head from the second liquid chamber.

(9) A liquid discharge device according to the disclosure comprises: an installation case configured to receive a cartridge, the cartridge comprising a first liquid chamber storing a liquid; a tank comprising a second liquid chamber; a flow path, one side of the flow path communicated with the second liquid chamber, and the other side of the flow path communicated with the first liquid chamber of the cartridge installed in the installation case; a head communicated with the second liquid chamber; a liquid level sensor; an interface; a memory; and a controller configured to: receive, from the liquid level sensor, a first signal indicating that a position of a liquid level in the second liquid chamber is equal to or higher than a predetermined; receive, from the liquid level sensor, a second signal indicating that the position of the liquid level in the second liquid chamber is lower than the predetermined position; read a liquid amount Vc of a liquid stored in the first liquid chamber from a cartridge memory of the cartridge through the interface; read a liquid amount Vs of a liquid stored in the second liquid chamber from the memory; based on at least the liquid amount Vc read from the cartridge memory and the liquid amount Vs read from the memory, calculate a threshold, the threshold being equivalent to the position of the liquid level in the second liquid chamber which is lower than the predetermined position; receive a discharge instruction to discharge a liquid through the head; update a count value with a value equivalent to an amount of the liquid instructed to be discharged by the received discharge instruction; and prohibit the discharge of the liquid through the head in a case the updated count value reaches the threshold.

According to the above configuration, even when the liquid level sensor breaks down, air is prevented from entering the head from the tank.

According to the disclosure, it is possible to notify the user of the exchange of cartridge or the ink empty even when the liquid level sensor breaks down. Further, it is possible to prevent air from entering the head from the tank even when the liquid level sensor breaks down.

What is claimed is:

1. A liquid discharge device comprising:

an installation case configured to receive a cartridge, the cartridge comprising a first liquid chamber storing a liquid;

a tank comprising a second liquid chamber;

a flow path, one side of the flow path communicated with the second liquid chamber, and the other side of the flow path communicated with the first liquid chamber of the cartridge installed in the installation case;

a head communicated with the second liquid chamber;

a liquid level sensor;

an interface;

a memory;

an alarm; and a controller configured to:

receive, from the liquid level sensor, a first signal indicating that a position of a liquid level in the second liquid chamber is equal to or higher than a predetermined position;

receive, from the liquid level sensor, a second signal indicating that the position of the liquid level in the second liquid chamber is lower than the predetermined position;

determine whether the cartridge is installed in the installation case;

based on determining that the cartridge is installed in the installation case, read a liquid amount Vc of a liquid stored in the first liquid chamber from a cartridge memory of the cartridge through the interface;

read a liquid amount Vs of a liquid stored in the second liquid chamber from the memory;

based on at least the liquid amount Vc read from the cartridge memory and the liquid amount Vs read from the memory, calculate a threshold, the threshold being equivalent to the position of the liquid level in the second liquid chamber which is lower than the predetermined position;

receive a discharge instruction to discharge a liquid through the head;

update a count value with a value equivalent to an amount of the liquid instructed to be discharged by the received discharge instruction; and operate the alarm in a case the updated count value reaches the threshold.

2. The liquid discharge device according to claim 1, wherein the controller is configured to:

based on determining that the cartridge is installed in the installation case, read information indicating an initial liquid amount Vc0 of a liquid stored initially in the first liquid chamber, from the cartridge memory;

based on the read information indicating the initial liquid amount Vc0, determine a correction value; and calculate the threshold by adding the read liquid amount Vc, the read liquid amount Vs, and the determined correction value to each other.

3. The liquid discharge device according to claim 2, wherein the controller is configured to calculate the correction value by multiplying a sum of the initial liquid amount Vc0 indicated by the read information and the read liquid amount Vs by a coefficient.

4. The liquid discharge device according to claim 3, wherein the controller is configured to calculate the correction value by further adding a fixed value to the value obtained by multiplying the sum of the initial liquid amount Vc0 indicated by the read information and the read liquid amount Vs by the coefficient.

5. The liquid discharge device according to claim 1, wherein the controller is configured to:

based on determining that the cartridge is installed in the installation case, read identification information stored in the cartridge memory through the interface from the cartridge memory of the cartridge installed in the installation case;

store the read identification information in the memory;

determine whether the cartridge is installed in the installation case at a predetermined time point from when the memory stores the identification information;

based on determining that the cartridge is installed in the installation case, read identification information stored in the cartridge memory through the interface from the cartridge memory of the cartridge installed in the installation case at the predetermined time point;

compare the identification information read from the cartridge memory with the identification information read from the memory; and in a case the compared identification information is different and the liquid amount Vc read from the cartridge memory is not zero, cancel the operation of the alarm.

6. The liquid discharge device according to claim 5, wherein the controller is configured to:

determine a total liquid amount which is a sum of the liquid amount Vc read from the cartridge memory and the liquid amount Vs read from the memory;

determine the liquid amount Vs of the second liquid chamber, from the determined total liquid amount when the liquid level of the first liquid chamber and the liquid level of the second liquid chamber are in equilibrium; and in a case the determined liquid amount Vs is larger than a liquid amount when the liquid level in the second liquid chamber is at the predetermined position, cancel the operation of the alarm.

7. The liquid discharge device according to claim 1, wherein the controller is configured to:

based on determining that the cartridge is installed in the installation case, access to the cartridge memory through the interface; and in a case the access to the cartridge memory through the interface is impossible, update the liquid amount Vs stored in the memory to a fixed value.

8. The liquid discharge device according to claim 1, wherein the controller is configured to prohibit the discharge of the liquid through the head when the updated count value reaches the threshold.

9. A liquid discharge device comprising:

an installation case configured to receive a cartridge, the cartridge comprising a first liquid chamber storing a liquid;

a tank comprising a second liquid chamber;

a flow path, one side of the flow path communicated with the second liquid chamber, and the other side of the flow path communicated with the first liquid chamber of the cartridge installed in the installation case;

a head communicated with the second liquid chamber;

a liquid level sensor;

an interface;

a memory; and a controller configured to:

receive, from the liquid level sensor, a first signal indicating that a position of a liquid level in the second liquid chamber is equal to or higher than a predetermined position;

receive, from the liquid level sensor, a second signal indicating that the position of the liquid level in the second liquid chamber is lower than the predetermined position;

read a liquid amount Vc of a liquid stored in the first liquid chamber from a cartridge memory of the cartridge through the interface;

read a liquid amount Vs of a liquid stored in the second liquid chamber from the memory;

based on at least the liquid amount Vc read from the cartridge memory and the liquid amount Vs read from the memory, calculate a threshold, the threshold being equivalent to the position of the liquid level in the second liquid chamber which is lower than the predetermined position;

receive a discharge instruction to discharge a liquid through the head;

update a count value with a value equivalent to an amount of the liquid instructed to be discharged by the received discharge instruction; and prohibit the discharge of the liquid through the head in a case the updated count value reaches the threshold.

* * * * *